US008555577B2

(12) United States Patent
Maday et al.

(10) Patent No.: US 8,555,577 B2
(45) Date of Patent: Oct. 15, 2013

(54) PANEL MOUNTING SYSTEM AND METHOD

(71) Applicant: Bellcomb, Inc., Minneapolis, MN (US)

(72) Inventors: Robert J. Maday, Winter Garden, FL (US); Kevin L. Shaw, Eden Prairie, MN (US); Darius Teichroew, Crystal, MN (US)

(73) Assignee: Bellcomb, Inc., Minneapolis, MN (US)

( * ) Notice: Subject to any disclaimer, the term of this patent is extended or adjusted under 35 U.S.C. 154(b) by 0 days.

(21) Appl. No.: 13/673,275

(22) Filed: Nov. 9, 2012

(65) Prior Publication Data

US 2013/0118107 A1 May 16, 2013

Related U.S. Application Data

(60) Provisional application No. 61/557,857, filed on Nov. 9, 2011.

(51) Int. Cl.
*E04B 2/00* (2006.01)
*E04B 2/18* (2006.01)

(52) U.S. Cl.
USPC ..... 52/235; 52/510; 52/506.08; 52/506.06

(58) Field of Classification Search
USPC ..... 52/235, 782.1, 582.1–585.1, 506.05, 52/507–513, 656.9, 463, 468, 384–385, 52/476, 391, 506.06, 506.04, FOR. 148, 52/475.1, 489.1
See application file for complete search history.

(56) References Cited

U.S. PATENT DOCUMENTS 2,065,510 A 12/1936 Bennett
3,465,996 A 9/1969 VonWedel
4,060,951 A * 12/1977 Gere ..... 52/508
4,070,835 A 1/1978 Reverend et al.
4,073,107 A 2/1978 Rousseau
4,483,122 A * 11/1984 Crandell ..... 52/747.1
4,782,635 A 11/1988 Hegle
4,831,805 A 5/1989 Noborisaka et al.
4,845,909 A 7/1989 Bailey
4,866,896 A * 9/1989 Shreiner et al. ..... 52/235
5,065,557 A * 11/1991 Laplante et al. ..... 52/235
(Continued)

FOREIGN PATENT DOCUMENTS

JP 05005350 A * 1/1993

OTHER PUBLICATIONS

International Search Report and Written Opinion for PCT/US2012/064431, dated Jan. 25, 2013, 14 pages.

*Primary Examiner* — Jeanette E. Chapman
(74) *Attorney, Agent, or Firm* — Fredrikson & Byron, PA

(57) ABSTRACT

A paneling system for external building walls includes: panels; bottom and top panel adapters attached to the panels with anchor plates; sill, head and wall girts; top and bottom panel shelves; and panel alignment mechanisms. The top panel shelves are configured for complimentary engagement with the top panel adapter and with the head and wall girts; and the bottom panel shelves are configured for complimentary engagement with the bottom panel adapters and with the sill and wall girts. A method for installing the paneling system includes attaching the sill, head wall girts to the wall; attaching the top and bottom panel shelves to the corresponding head girt, sill girt or wall girt; attaching the top and bottom panel adapters to each panel; attaching top panel adapters to the top panel shelves; attaching the bottom panel adapters to the bottom panel shelves; and aligning the panel using the adjustment mechanism.

24 Claims, 14 Drawing Sheets

(56) References Cited

U.S. PATENT DOCUMENTS

| | | | | |
|---|---|---|---|---|
| 5,067,292 | A | 11/1991 | Finean | |
| 5,083,405 | A | 1/1992 | Miller | |
| 5,094,051 | A | 3/1992 | Miller | |
| 5,449,542 | A | 9/1995 | Chiba et al. | |
| 5,505,029 | A | 4/1996 | Lind | |
| 6,035,598 | A | 3/2000 | Sukolics | |
| 6,427,410 | B1 | 8/2002 | Lind | |
| 6,594,962 | B2 | 7/2003 | Pardue | |
| 8,033,066 | B2 * | 10/2011 | Griffiths | 52/235 |
| 8,127,507 | B1 * | 3/2012 | Bilge | 52/235 |
| 2007/0022682 | A1 * | 2/2007 | Morgenegg et al. | 52/235 |
| 2010/0263314 | A1 | 10/2010 | Macdonald et al. | |
| 2012/0186170 | A1 * | 7/2012 | Macdonald et al. | 52/173.3 |

* cited by examiner

PANEL MOUNTING SYSTEM AND METHOD

CROSS-REFERENCE TO RELATED APPLICATIONS

This application claims priority to U.S. Provisional Patent Application Ser. No. 61/557,857 filed Nov. 9, 2011, which is incorporated herein in its entirety by reference.

TECHNICAL FIELD

The present disclosure relates to a paneling system. In particular, the disclosure pertains to a paneling system for an exterior surface of an exterior building wall.

BACKGROUND

It is very common in architecture to cover a basic supporting wall, for instance an exterior surface of an exterior building wall of concrete or the like, with a plurality of panels for aesthetics, for protection, or for both. The panels are attached to the exterior structure of a building by brackets which are themselves attached to the structure after the structure has been erected. The brackets need to be very accurately positioned when they are attached to the structure if they are to support the panels in the correct position. For proper positioning, it is necessary that the panels be adjustable relative to one another as well as relative to the supporting wall.

Prior art paneling systems are referred to as "progressive" paneling systems because each adjacent panel must be installed in sequence. For example, in order to install a row of panels, the process must begin by installing a first panel at one of the two side edges of a wall and then consecutively installing additional panels, one at a time, as the installation process progress from one side edge of the building to the other side edge.

Over the useful life of the building, it becomes necessary to replace one or more panels that are damaged because of their exposure to ever changing weather conditions, cracking, etc. Because of the "progressive" nature of prior art paneling systems, it is generally necessary to remove one or more of the adjacent panels for accessing, removing and replacing the damaged panel(s) anywhere on the exterior surface of the building.

Accordingly, there exists a need for a "non-progressive" paneling system providing access to any one or more of the individual panels anywhere on the exterior surface of the exterior wall.

SUMMARY

An embodiment of a paneling system of the instant disclosure includes one or more panels, wherein each panel is configured for affixing (or securing) one or more anchor plates to a back surface of the panel. Each anchor plate is configured for engaging one or more fastening devices with which at least one bottom panel adapter is affixed to at least one anchor plate proximate a bottom edge of each panel, and with which at least one top panel adapter is affixed to at least one anchor plate proximate a top edge of each panel. The paneling system further includes one or more bottom panel shelves and one or more top panel shelves. A first channel protruding from a front surface of each bottom panel shelf is configured for retaining (or engaging) therewithin at least a portion of an edge of the one or more bottom panel adapters. Each bottom panel shelf includes one or more adjustment mechanisms configured for plumbing the panel attached to the bottom panel adapter retained within the first channel of the bottom panel shelf. A back surface of each bottom panel shelf is configured for engagement with a front surface of a sill girt affixed to a wall. A second channel protruding from a front surface of each top panel shelf is configured for retaining therewithin at least a portion of an edge of said one or more top panel adapters. A back surface of each top panel shelf is configured for engagement with a front surface of a head girt affixed to said wall.

Some embodiments of said paneling system of the instant disclosure include one or more panel shelves, wherein each panel shelf includes a first section substantially similar to the bottom panel shelf and a second section substantially similar to the top panel shelf. The paneling system additionally includes a wall girt configured for affixation to said wall, and including a first section substantially similar to the sill girt and a second section substantially similar to the head girt. A front surface of the wall girt is configured for engagement with a back surface of the panel shelf.

An embodiment of a method for installing a paneling system includes affixing (or securing) a back surface of two or more anchor plates to a back surface of each of one or more panels and engaging one or more fastening devices in each one of a pair of substantially parallel channels on a front surface of each anchor plate. The one or more fastening devices are used for affixing one or more bottom panel adapter to a front surface of at least one of the anchor plates affixed along a bottom edge of each panel. Additional one or more fastening devices are used for affixing one or more top panel adapter to a front surface of at least one of the anchor plates affixed along a top edge of each panel. A sill girt is affixed along a bottom edge of a wall and one or more bottom panel shelves, each including a back surface configured for engagement with a front surface of the sill girt, is affixed to the sill girt and/or to the wall. A head girt is affixed along a top edge of the wall and one or more top panel shelves, each including a back surface configured for engagement with a front surface of the head girt, is affixed to the head girt and/or to the wall. At least a portion of an edge of each top panel adapter is received and engaged in one or more top panel shelves, and then at least a portion of an edge of each bottom panel adapter is received and engaged in one or more bottom panel shelves. Each panel is then plumbed by manipulating an adjustment mechanism in each bottom panel shelf.

In some embodiments of the method for installing a paneling system, one or more wall girts are affixed (or secured) on the wall at locations between the head and sill girts. One or more panel shelves, each including a back surface configured for engagement with a front surface of a wall girt is affixed to the wall girt and/or to the wall. One or more top panel adapters are received and engaged in that section of one or more panel shelf that substantially resembles the top panel shelf. And, one or more bottom panel adapters are received and engaged in that section of one or more panel shelf that substantially resembles the bottom panel shelf. Each panel is then plumbed by manipulating an adjustment mechanism in each bottom panel shelf.

DETAILED DESCRIPTION

Figure 1B:
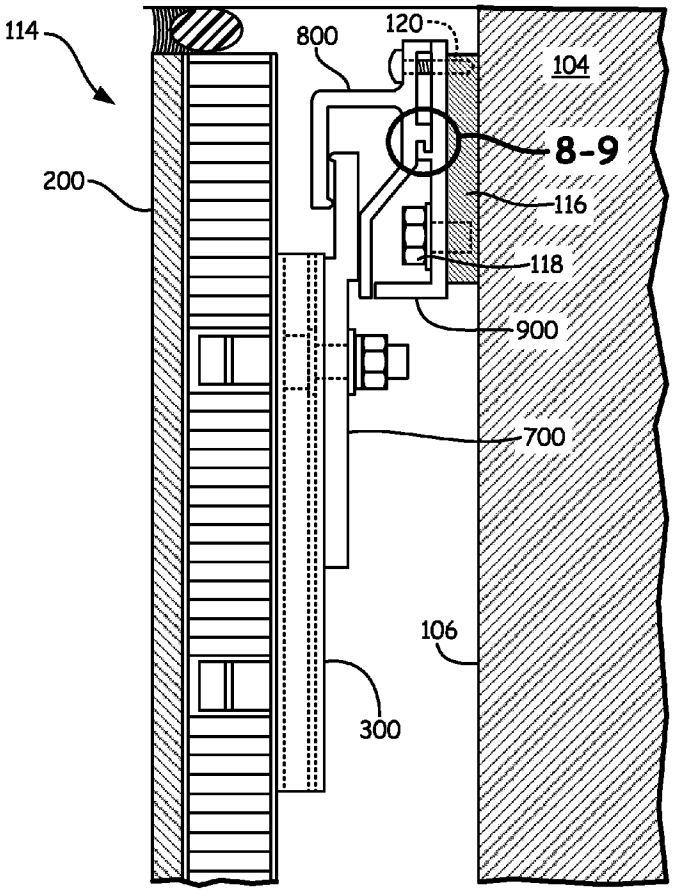
FIG. 1B is a partial side end view of an embodiment of a panel installed proximate a top of the wall.

While multiple embodiments are disclosed, alternate and/or additional embodiments may become apparent to those skilled in the art. In the following, one or more non-limiting exemplary embodiments are described with reference to the accompanying drawings wherein like elements are designated by like numerals. It should be clearly understood that the metes and bounds of the disclosure is neither limited to nor is there any explicit or implicit intent to limit the disclosure in any form or manner to that described and/or illustrated herein. As such, all alternatives as may become apparent are considered as falling within the metes and bounds of the instant disclosure.

In the following, only one single reference numeral is used for all panels regardless of variations in their features or material or their location along an exterior surface of an exterior building wall. Designating all panels with the same reference numeral is appropriate because all panels share common features and/or construction. Additionally, while some of the components of the paneling system for installing a top edge of an individual panel are different from the component for installing a bottom edge of the same or different panel, the components for installing the top edges of all the panels or sections thereof are identical as are the components for installing the bottom edges of all the panels or sections thereof. Any substantive differentiation or distinction is appropriately identified and described as necessary.

Figure 1A:
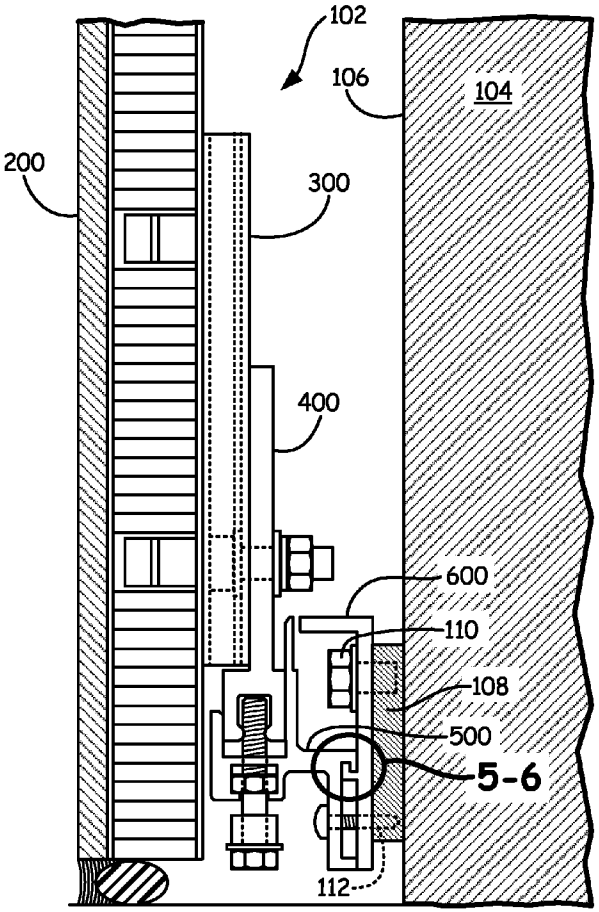
FIG. 1A is a partial side end view of an embodiment of a panel installed proximate a bottom of a wall.

FIG. 1A illustrates a non-limiting exemplary embodiment of paneling system 102 for a row of panels 200 installed proximate a bottom of exterior building wall 104. Paneling system 102 includes one or more panels 200 having one or more anchor plates 300 affixed (or secured or attached) to a back surface of each panel 200. For attaching a bottom edge of panel 200 to wall 104, at least one bottom panel adapter 400 is secured (or affixed or attached) to each anchor plate 300 along the bottom edge of panel 200. At least a portion of each bottom panel adapter 400 is received in one or more bottom panel shelves 500 attached to sill gifts 600 affixed to exterior surface 106 of wall 104. As such, bottom panel adapter 400 and bottom panel shelf 500 are interfacing or interlocking components in an embodiment of paneling system 102 for attaching or securing panels 200 to exterior surface 106 of exterior wall 104. In some embodiments, bottom panel shelf 500 and sill girt 600 are configured for complementary engagement. One such non-limiting exemplary embodiment of a configuration for complementary engagement of a back surface of bottom panel shelf 500 and a front surface of sill girt 600 is illustrated in FIG. 1A at call-out 5-6. In some embodiments, one or more shims 108 are necessitated between sill girts 600 and wall 104 to adjust for abnormalities of and/or on exterior surface 106. As illustrated, one or more fastening devices 110 affixing (or securing) sill girt 600 to wall 104 extends through shims 108 placed therebetween, and one or more fastening devices 112 affix bottom panel shelf 500 and sill girt 600 to shims 108. In an alternate embodiment, one or more fastening devices 112 affixing bottom panel shelf 500 and sill girts 600 to wall 104 extends through shims 108. In other embodiments wherein shims 108 are not necessary and/or not used, one or more fastening devices 110 affix sill girt 600 directly to wall 104, and one or more fastening devices 112 affix bottom panel shelf 500 and sill girt 600 directly to wall 104. Each component of paneling system 102, viz., panels 200, anchor plates 300, bottom panel adapters 400, bottom panel shelves 500, and sill girts 600, respectively, are described herein below with reference to FIGS. 2, 3, 4, 5, and 6.

FIG. 1B illustrates a non-limiting exemplary embodiment of paneling system 114 for a row of panels 200 installed proximate a top of exterior building wall 104. Paneling system 114 includes one or more panels 200 having one or more anchor plates 300 affixed to the back surface of each panel 200. For attaching a top edge of panel 200 to wall 104, at least one top panel adapter 700 is affixed to each anchor plate 300 along the top edge of panel 200. At least a portion of each top panel adapter 700 is received in one or more top panel shelf 800 attached to head girt 900 affixed to exterior surface 106 of wall 104. As such, top panel adapter 700 and top panel shelf 800 are interfacing and interlocking components in an embodiment of paneling system 114 for attaching or securing panels 200 to exterior surface 106 of exterior wall 104. In some embodiments, top panel shelf 800 and head girt 900 are configured for complementary engagement. One such non-limiting exemplary embodiment of a configuration for complementary engagement of a back surface of top panel shelf 800 and a front surface of head girt 900 is illustrated in FIG. 1B at call-out 8-9. In some embodiments, one or more shims 116 are necessitated between head girts 900 and wall 104 to adjust for abnormalities of and/or on exterior surface 106. As illustrated, one or more fastening devices 118 affixing (or securing) head girt 900 to wall 104 extends through shims 116 placed therebetween, and one or more fastening devices 120 affix top panel shelf 800 and head girt 900 to shims 116.

In an alternate embodiment, one or more fastening devices 120 affixing top panel shelf 800 and head girts 900 to wall 104 extends through shims 116. In other embodiments wherein shims 116 are not necessary and/or not used, one or more fastening devices 118 affix head girt 900 directly to wall 104, and one or more fastening devices 120 affix top panel shelf 800 and head girt 900 directly to wall 104. Components of paneling system 114 that are different from those for paneling system 102, viz., top panel adapters 700, top panel shelves 800, and head gifts 900, respectively, are described herein below with reference to FIGS. 7, 8, and 9.

Figure 1C:
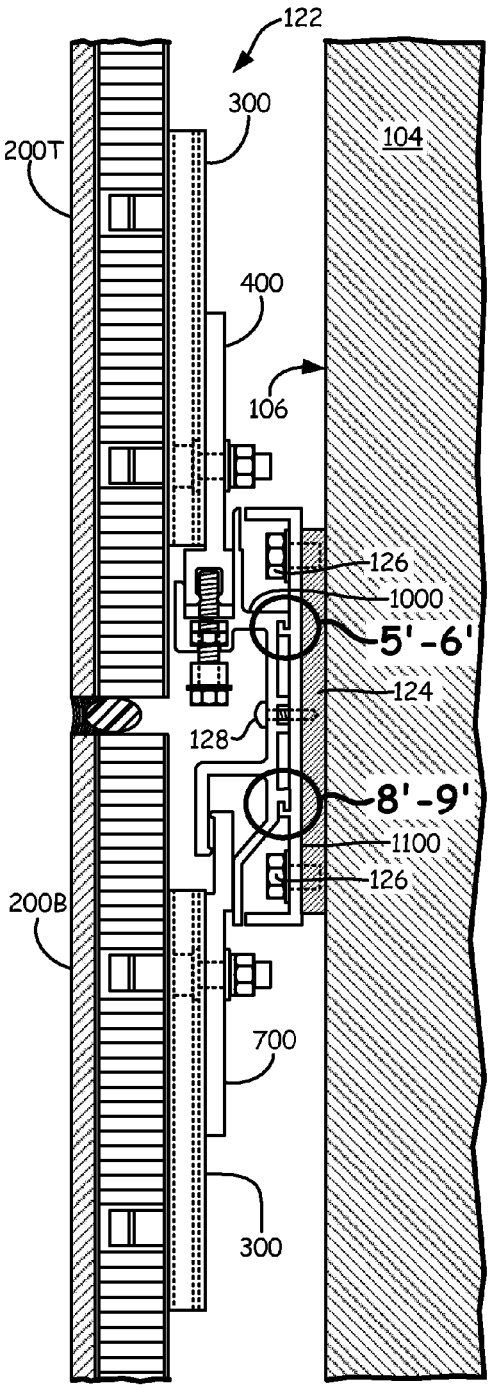
FIG. 1C is a partial side end view of an embodiment of two vertically adjacent panels installed on the wall.

FIG. 1C is a non-limiting exemplary embodiment of paneling system 122 illustrating vertically adjacent rows of panels installed on exterior surface 106 of exterior building wall 104. As with paneling systems 102 and 114, vertically adjacent panels 200 of paneling system 122, indicated as top and bottom panels 200T and 200B, respectively, include one or more anchor plates 300 affixed to the back surface of each panel 200. As illustrated, at least one anchor plate 300 is affixed at each one of the four corners of each panel 200. As with paneling system 102, attaching the bottom edge of top panel 200T to wall 104 requires at least one bottom panel adapter 400 affixed to each anchor plate 300 along the bottom edge of top panel 200T. And, as with paneling system 114, attaching the top edge of bottom panel 200B to wall 104 requires at least one top panel adapter 700 affixed to each anchor plate 300 along the top edge of bottom panel 200B. While the embodiment illustrated in FIG. 1C is described as including four anchor plates affixed one at each corner of panel 200, alternate embodiments of paneling system 122 include more than four or less than four anchor plates affixed at the same or different locations than those described.

As described herein above with reference to FIGS. 1A and 1B, bottom panel adapter 400 is received in bottom panel shelf 500, and top panel adapter 700 is received in top panel shelf 800. In contrast to paneling system 102 and 114, paneling system 122 includes one or more panel shelves 1000 for receiving both bottom and top panel adapters 400 and 700, respectively. As can be seen, and as described herein below with reference to FIG. 10A, panel shelf 1000 is a unitary single one-piece component equivalent to, and replacement for, bottom panel shelf 500 and top panel shelf 800. In other words, panel shelf 1000 is a unitary single one-piece component defined at least in part by bottom panel shelf 500 and top panel shelf 800. Stated alternatively, panel shelf 1000 is a unitary single one-piece component having two sections of which one section is substantially similar to bottom panel shelf 500 and the other section is substantially similar to top panel shelf 800. As with paneling system 102 illustrated in FIG. 1A, the bottom edge of each top panel 200T is attached to wall 104 by receiving at least a portion of each bottom panel adapter 400 attached to top panel 200T in that portion of panel shelf 1000 which resembles bottom panel shelf 500. And, as with paneling system 114 illustrated in FIG. 1B, the top edge of each bottom panel 200B is attached to wall 104 by receiving at least a portion of each top panel adapter 700 attached to bottom panel 200B in that portion of panel shelf 1000 which resembles top panel shelf 800.

Also as described herein above with reference to FIGS. 1A and 1B, bottom panel shelf 500 is attached to sill girt 600, and top panel shelf 800 is attached to head girt 900. In contrast to paneling systems 102 and 114, paneling system 122 includes one or more wall girts 1100 for attaching one or more panel shelves 1000 thereto. As can be seen, and as described herein below with reference to FIG. 11, wall girt 1100 is a unitary single one-piece component equivalent to, and replacement for, sill girt 600 and head girt 900. In other words, wall girt 1100 is a unitary single one-piece component defined at least in part by sill girt 600 and head girt 900. Stated alternatively, wall girt 1100 is a unitary single one-piece component having two sections of which one section is substantially similar to sill girt 600 and the other section is substantially similar to head girt 900. Wall girt 1100 is affixed to exterior surface 106 of wall 104. In some embodiments, one or more shims 124 are necessitated between wall girts 1100 and wall 104 to adjust for abnormalities of and/or on exterior surface 106. As illustrated, one or more fastening devices 126 affixing (or securing) wall girt 1100 to wall 104 extends through shims 124 placed therebetween, and one or more fastening devices 128 affix panel shelf 1000 and wall girt 1100 to shims 124. In an alternate embodiment, one or more fastening devices 126 affixing panel shelf 1000 and wall girt 1100 to wall 104 extends through shims 124. In other embodiments wherein shims 124 are not necessary and/or not used, one or more fastening devices 126 affix wall girt 1100 directly to wall 104, and one or more fastening devices 126 affix panel shelf 1000 and wall girt 1100 directly to wall 104.

In some embodiments of paneling system 122, panel shelf 1000 and wall girt 1100 are configured for complementary engagement. One such non-limiting exemplary embodiment of a configuration for complementary engagement of a back surface of panel shelf 1000 and a front surface of wall girt 1100 are illustrated in FIG. 1C at call-outs 5'-6' and 8'-9'.

Figure 1D:
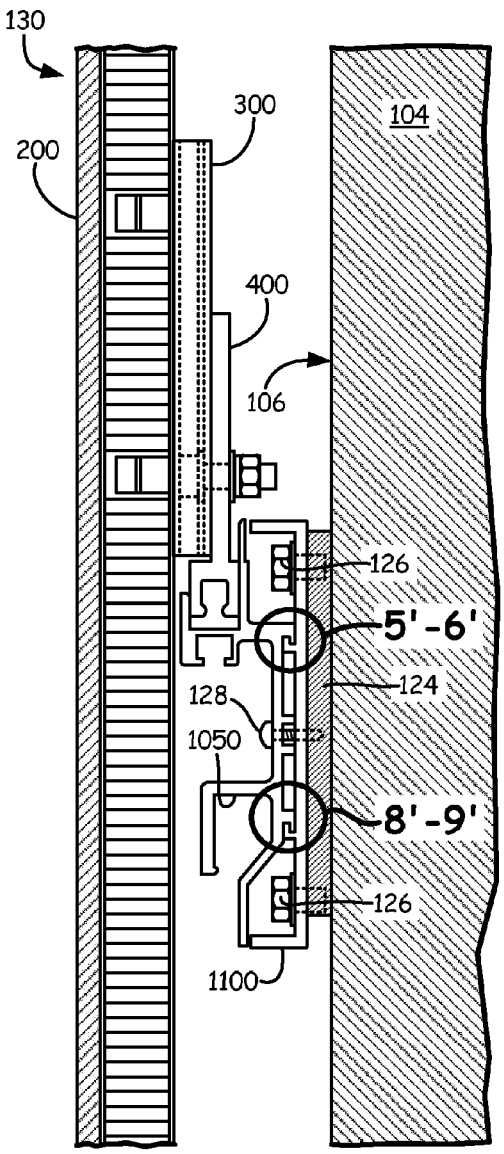
FIG. 1D is a partial side end view of an embodiment of a panel attached to the wall.

Under certain circumstances, such as when panel 200 is taller than a predefined height and/or when panel 200 is heavier than a predefined weight and/or for additional securement of panel 200 to wall 104, etc., it may be desirable and/or necessary to attach panel 200 to wall 104 at additional and/or alternative locations other than at the top and bottom edges of panel 200. One such embodiment is paneling system 130 illustrated in FIG. 1D wherein one or more additional bottom panel adapters 400, each affixed to at least one anchor plate 300 on the back surface of panel 200, is provided in combination either with one or more panel shelves 1050 attached to wall girt 1100 or with one or more bottom panel shelf 500 attached to sill girt 600. As will be evident, and as described herein below with reference to FIG. 10B, panel shelf 1050 is substantially similar to panel shelf 1000. Additional and/or alternate embodiments of paneling systems include one or more additional top panel adapters 700, each affixed (or secured or attached) to at least one anchor plate 300 at additional and/or alternate locations on the back surface of panel 200 in combination either with one or more panel shelves 1000 or 1050 attached to wall girts 1100 or with one or more top panel shelf 800 attached to head girts 900. As illustrated in FIG. 1D, wall girts 1100 of paneling system 130 are affixed (or secured) to external surface 106 of wall 104 in substantially the same manner as wall girts 1100 of paneling system 122 illustrated in FIG. 1C. Additionally, panel shelf 1050 and wall girts 1100 are affixed (or secured) to shims 124 and/or to wall 104 in substantially the same manner as are panel shelf 1000 and wall girts 1100 as described herein above with reference to FIG. 1C.

Figure 2B:
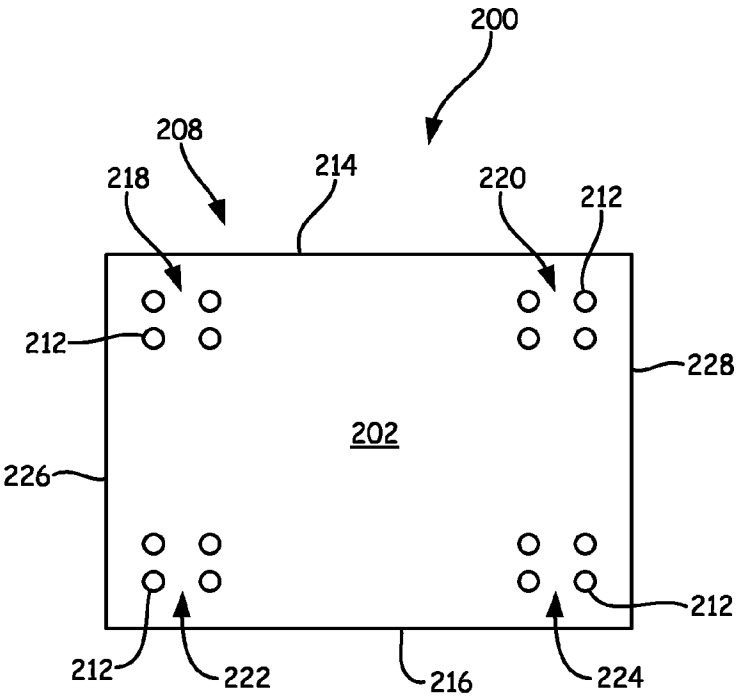
FIG. 2B illustrates a back surface of the panel of FIG. 2A.
Figure 2A:
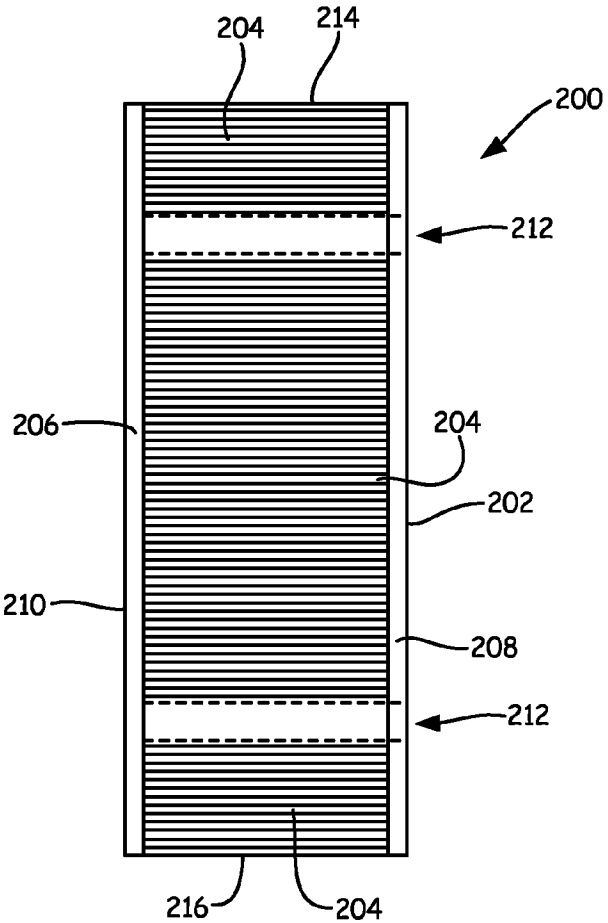
FIG. 2A shows a cross-section of an embodiment of a panel as viewed from one of the two side edges of the panel.

FIG. 2A is a cross-sectional view from one of the two side edges of panel 200, and FIG. 2B shows back surface 202 of panel 200 in accordance with a non-limiting exemplary embodiment of a paneling system. Certain embodiments of panel 200 include core 204 sandwiched between front sheet 206 and back sheet 208. In some embodiments, front sheet 206 is a sheet of metal or wood or plastic or a composite (for example fiberglass) and such, configured for affixing a veneer, including decorative stone, marble, wood, plastic, etc., to front surface 210 of panel 200. One or more holes 212 in back surface 202 extend through back sheet 208 and into at least a portion of core 204 of panel 200. While FIG. 2A illustrates one or more holes 212 extending through the entire thickness of core 204, this is not always necessary. In alternate embodiments, one or more holes 212 extend into only a portion of core 204. While FIG. 2A may be considered as implying that core 204 fills the entire space (or distance) between front and back sheets 206 and 208, respectively, this again is not always necessary. In some embodiments, core 204 occupies one or more pre-defined regions for enabling one or more holes 212 with the remaining space between front and back sheets 206 and 208, respectively, being void or filled or any combination thereof.

As described herein below with reference to FIGS. 3A and 3B, one or more holes 212 in some embodiments of panel 200 are used for affixing (or securing or attaching) one or more anchor plates 300 to back surface 202 of panel 200. As described herein above with reference to FIGS. 1A-1D, and as will be apparent from the description herein below with reference to FIGS. 4 and 7, anchor plates 300 provide a base or interface for affixing bottom and top panel adapters 400 and 700, respectively, to panels 200. Accordingly, one or more holes 212 are provided at predefined locations in conformance with the design of anchor plates 300. One such arrangement of holes 212 is illustrated in FIG. 2B, wherein groups 218 and 220 each having four holes 212 are provided on back surface 202 proximate top edge 214 of panel 200, and groups 222 and 224 each having four holes 212 are provided on back surface 202 proximate bottom edge 216 of panel 200. While the embodiment of panel 200 illustrated in FIG. 3B is described as including four groups of holes, alternate embodiments of panel 200 include more than or less than four groups of holes. In other embodiments of panel 200, any one or more groups of holes have less than or more than four holes 212 each.

While FIG. 2B illustrates an embodiment of panel 200 wherein at least one anchor plate 300 can be affixed to each one of four corner groups 218, 220, 222 and 224, alternate embodiments can include additional or fewer anchor plates 300. For instance, panels 200 that are wider than a predefined width may necessitate additional anchor plates 300, and accordingly necessitate additional holes 212 or groups of holes 212, along top edge 214 between groups 218 and 220 and along bottom edge 216 between groups 222 and 224. Similarly, panels 200 that are taller than a predefined height, such as the embodiment illustrated in FIG. 1D, may necessitate additional anchor plates 300, and accordingly necessitate additional holes 212 or groups of holes 212, along side edge 226 between groups 218 and 222, and along side edge 228 between groups 220 and 224. Furthermore, panels 200 that exceed predefined width and height and/or weight may necessitate additional anchor plates 300, and accordingly necessitate additional holes 212, at additional locations on back surface 202. As will be apparent, panels 200 of relatively small widths and/or heights might require only one group of holes 212 proximate top edge 214 and one group of holes 212 proximate bottom edge 216. Therefore, it should be evident that installment (by attachment or affixment or securement) of the top and bottom of one panel 200 generally requires at least one anchor plate 300 proximate top edge 214 and at least one anchor plate 300 proximate bottom edge 216.

In alternate embodiments, one or more anchor plates 300 are configured for affixation directly onto back surface 202 of panel 200 without the need for one or more holes 212.

Figure 3A:
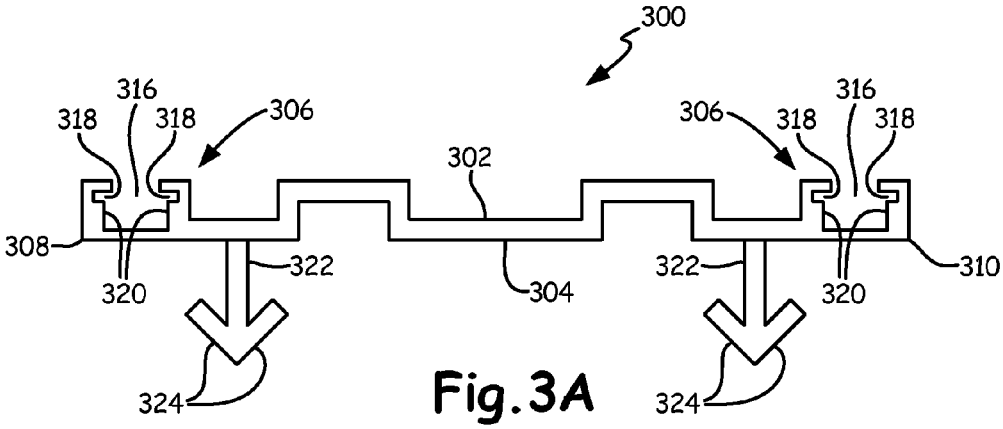
FIG. 3A shows a cross-section of an embodiment of an anchor plate as viewed from the top and/or bottom edges of the anchor plate.
Figure 3B:
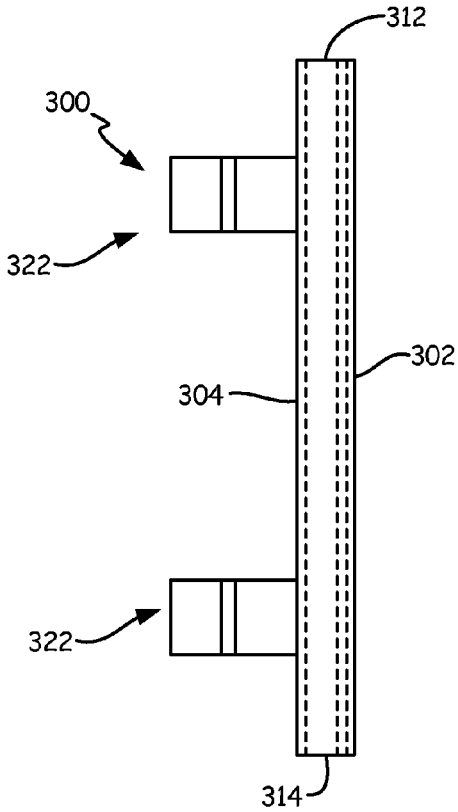
FIG. 3B is a cross-section of the anchor plate of FIG. 3A as viewed from either one of the two side edges.

FIG. 3A is a cross-section of an embodiment of anchor plate 300 as viewed from the top or bottom edge thereof, and FIG. 3B is a cross-section of anchor plate 300 as viewed from one of the two side edges thereof. As illustrated, anchor plate 300 includes front surface 302 configured for engaging one or more fastening devices (not shown), and back surface 304 configured for affixation to panel 200. At least one pair of parallel and spaced apart channels 306 extend across at least a portion of front surface 302. In some embodiments of anchor plate 300, one or both channels 306 extend along opposed side edges 308 and 310 between top and bottom edges 312 and 314, respectively. Other embodiments of anchor plate 300 include one or both channels 306 extending along a portion of one or both opposed side edges 308 and 310. In alternate embodiments of anchor plate 300, one or both parallel channels 306 on at least a portion of front surface 302 are offset from one or both side edges 308 and 310. Yet other embodiments of anchor plate 300 include one or both parallel channels 306 extending not on front surface 302, but along one or both opposed and parallel side edges 308 and 310. All alternative configurations of channels 306 and/or embodiments for engaging one or more fastening devices are considered as being within the metes and bounds of the instant disclosure.

In an embodiment of anchor plate 300, each one of parallel channels 306, is configured along its entire extent, or at least a portion thereof, for engaging and inhibiting a rotation of a head of a fastening device. As illustrated in FIG. 3A, channel 306 includes groove 316 configured for receiving the head of the fastening device, and opposing slots 318 configured for receiving a flange attached to the head or a washer adjacent the head and around a shank of the fastening device. As will be apparent to one skilled in the art, receipt of the head in groove 316 and receipt of the flange or washer in slots 318 will enable retention of the head of the fastening device within channel 306 with the shank of the fastening device extending out of groove 316 and away from front surface 302 of anchor plate 300. Accordingly, fastening devices engaged within channel 306 are removable by sliding their respective head and flange or washer out of either one of the two ends of groove 316 and slots 318.

In an embodiment of anchor plate 300, groove 316 of channel 306 is configured having a width essentially equal to or slightly larger than a distance between opposing parallel edges of the head of the fastening device. As such, the head of the fastening device is received in groove 316 and the fastening device can be positioned at any desired location along the extent of channel 306. As will be apparent to one skilled in the art, the opposing parallel edges of the head will be in substantially close proximity of, or in loose or slideable contact with opposing parallel walls 320 of groove 316. Therefore, opposing parallel walls 320 will engage the head of the fastening device in substantially the same manner as the jaws of a wrench. Accordingly, in embodiments wherein the fastening device is a bolt, the head of the bolt will be in a non-slip engagement within channel 306 thereby enabling the rotation of a cooperative nut around the threaded shank of the bolt. As will be appreciated, such an arrangement enables affixing or securing a part or a component having one or more holes through which the shanks of the fastening devices extend. Bottom and top panel adapters 400 and 700, respectively, and the affixation of each to at least one anchor plate 300 is described herein below with reference to their respective FIGS. 4 and 7.

As illustrated in FIGS. 3A and 3B, an embodiment of anchor plate 300 includes one or more standoffs 322 protruding from back surface 304. One or more barbs 324 protruding from each standoff 322, as will be evident from the description herein below, might enhance the securement of anchor plate 300 to back surface 202 of panel 200. Referring back to FIGS. 1A-2B, embodiments of paneling systems 102, 114, 122 and 130 are described as having one or more anchor plates 300 affixed to back surface 202 of panel 200. Accordingly, the locations of one or more holes 212 on back surface 202 of panel 200 have substantially the same positional relationship as the one or more standoffs 322 protruding from back surface 304 of anchor plate 300. For affixing anchor plate 300 to panel 200, standoffs 322 are placed within corresponding holes 212 with back surface 304 of anchor plate 300 contacting back surface 202 of panel 200. In some embodiments, one or more interlocking structures or mechanisms secure each standoff 322 in corresponding hole 212. As will be evident to one skilled in the art, barbs 324 protruding from standoffs 322 are a component of such interlocking structures or mechanisms. In alternate embodiments, a one or more compositions such as an adhesive, caulk, building construction glue, structural potting compound, etc., are utilized for affixing (or securing) anchor plate 300 to panel 200. In other embodiments, a combination of an interlocking structure or mechanism and one or more compositions are utilized for affixing (or securing) anchor plate 300 to panel 200. In an embodiment wherein one or more compositions are used, holes 212 are filled with the composition and each standoff 322 is submerged or inserted into one composition-filled hole 212. As will be evident to one skilled in the art, barbs 324 protruding from standoffs 322 increase the adherence surface area available for the one or more compositions, and therefore enhance the securement of anchor plate 300 to panels 200. While standoffs 322 are illustrated including barbs 324, it should be further evident that any configuration contributing towards increasing the surface area for the adhesive can be used, and all such embodiments are considered as being within the metes and bounds of the instant disclosure. Additionally, or alternatively, adhesive is applied to back surface 304 and/or to a corresponding opposite portion of back surface 202 prior to placing back surfaces 202 and 304 in contact with one another. In some embodiments, standoffs 322 do not include barbs 324 or any similar configurations. In alternate embodiments, anchor plates 300 do not include standoffs 322 protruding from back surface 304. Therefore, holes 212 are not required and anchor plates 300 are affixed to panels 200 by applying adhesive to back surface 304 and/or to a corresponding opposite portion of back surface 202 prior to placing back surfaces 202 and 304 in contact with one another. In certain embodiments, panel 200 and anchor plate 300 are attached (or secured or affixed) to one another by mechanisms including, and not limited to, brazing, welding, soldering, etc. In a non-limiting exemplary embodiment, panel 200 and anchor plate 300 are manufactured as a unitary single one-piece component.

FIGS. 3A and 3B illustrate an embodiment of anchor plate 300 including stepped front and back surfaces 302 and 304, respectively, defining channel spaces between parallel channels 306. Alternate embodiments of anchor plates 300 have substantially flat front and back surfaces 302 and 304, respectively, and do not define channel spaces. In some embodiments of anchor plates 300, the stepped surfaces function as standoffs and provide separation between back surface 304 and back surface 202 of panel 200 and between front surface 302 and bottom/top panel adapters 400/700. In additional and/or alternative embodiments of anchor plates 300, the stepped surfaces enhance the structural integrity of anchor plates 300.

Figure 4:
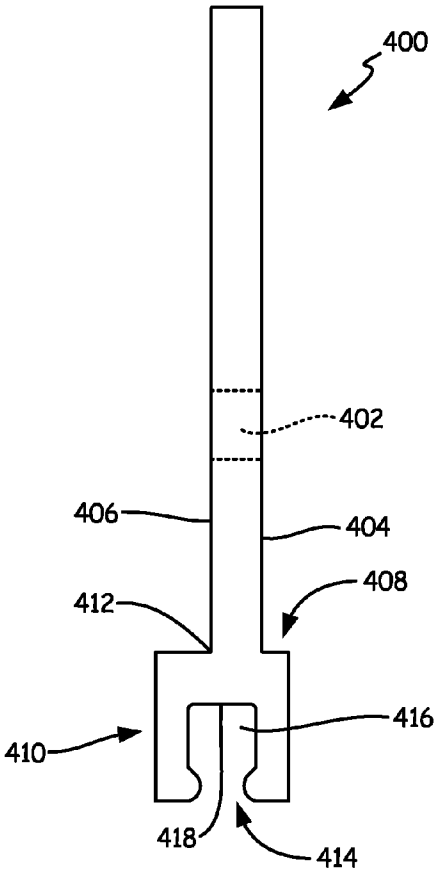
FIG. 4 is a side end view of an embodiment of a bottom panel adapter as viewed from either one of the two side edges.

FIG. 4 illustrates a side end view of a non-limiting exemplary embodiment of bottom panel adapter 400 as viewed from either one of its two side edges. Bottom panel adapter 400 includes two or more spaced apart holes 402 extending therethrough between front and back surfaces 404 and 406, respectively. As described herein above, at least one bottom panel adapter 400 is secured to each anchor plate 300 affixed proximate bottom edge 216 of panel 200, and each anchor plate 300 includes at least one pair of parallel channels 306 each configured for non-slip engagement of the head of a fastening device having a shank extending away from front surface 302 of anchor plate 300. Accordingly, holes 402 are positioned and provided to permit passage of the shanks of the fastening devices engaged in channels 306. Bottom panel adapter 400 is thus appropriately positioned on and secured to anchor plate 300. If the fastening device is a bolt, as previously described, then a cooperative nut on the threaded shank of the bolt is tightened against front surface 404 of bottom panel adapter 400 with back surface 406 in contact with front surface 302 of anchor plate 300 and the head of the bolt engaged within channel 306 with the shank extending from groove 316 through hole 402. In some embodiments a washer, for example a locking washer, is placed around the shank of the bolt between the nut and front surface 404. Alternate embodiments for securing bottom panel adapter 400 to anchor plate 300, as will be apparent to one skilled in the art, are considered as being within the metes and bounds of the instant disclosure.

As described herein above with reference to FIG. 1A, at least a portion of each bottom panel adapter 400 is received in one or more bottom panel shelves 500 attached to sill girts 600 affixed to the exterior surface of wall 104. As such, bottom panel adapter 400 and bottom panel shelf 500 are an interfacing or interlocking components of an embodiment of a paneling system for attaching or securing panels 200 to exterior surface 106 of exterior wall 104. Therefore, before further describing the additional features or components of bottom panel adapter 400, attention is first directed to some of the features of bottom panel shelf 500 shown in FIG. 5.

Figure 5:
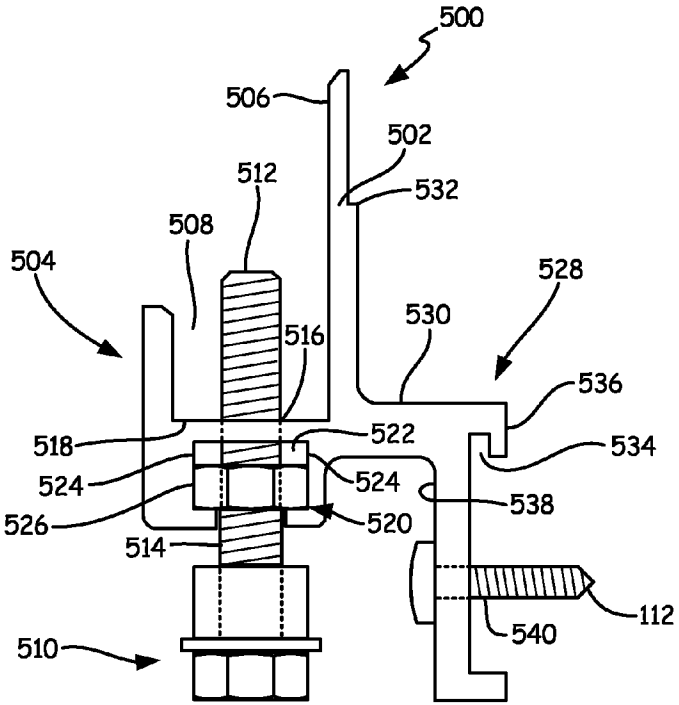
FIG. 5 is a side end view of an embodiment of a bottom panel shelf as viewed from either one of the two side edges.

FIG. 5 is a non-limiting exemplary embodiment of bottom panel shelf 500 as viewed from one of its two side edges. Wall 502 of each bottom panel shelf 500 includes channel 504 protruding from front surface 506 thereof. As illustrated, channel 504 includes groove 508 configured for receiving at least a portion of bottom panel adapter 400. In general groove 508 will receive bottom 408 of bottom panel adapter 400. Accordingly, some embodiments of bottom panel shelf 500 include an adjustment mechanism for plumbing and/or adjusting a height of panel 200 attached to bottom panel adapter 400. In certain embodiments, at least a portion of the adjustment mechanism extends through and/or extends within groove 508 which receives bottom 408 of bottom panel adapter 400 to which panel 200 is attached. In some embodiments of bottom panel shelf 500, at least a portion of the adjustment mechanism extends through holes 516 in wall 518 of channel 504 and into groove 508. As such, at least a portion of the adjustment mechanism will be in close proximity of and/or in contact with at least a portion of a surface of bottom 408 of bottom panel adapter 400 retained within groove 508 of channel 504. Accordingly, panel 200 attached to bottom panel adapter 400 can be plumbed and/or adjusted in height by manipulating at least a portion of the adjustment mechanism extending within and/or extending through groove 508 of channel 504. In alternate embodiments of bottom panel shelf 500, each channel 504 includes one or more jacking bolts 510 or other jacking devices having tip (or end) 512 of shank 514 thereof extending through hole 516 in wall 518 and into groove 508 of channel 504. As such, tip 512 of each jacking bolt 510 will be in close proximity of or in contact with a surface of bottom 408 of bottom panel adapter 400 retained within groove 508 of channel 504. Accordingly, the extent of bottom panel adapter 400 retained within groove 508 of channel 504 is adjustable by manipulating the portion of each jacking bolt 510 extending into groove 508.

In a non-limiting exemplary embodiment of bottom panel shelf 500 having one or more jacking bolts 510, each panel 200 can be plumbed and/or adjusted in height as follow. As described herein above, each panel 200 will include at least one bottom panel adapter 400 secured to at least one anchor plate 300 affixed on back surface 202 along bottom edge 216 of panel 200. Once a bottom panel adapter 400 is placed within channel 504 of its corresponding bottom panel shelf 500, bottom 408 will be in contact with or in close proximity of tip 512 such that one or more jacking bolt 510 can be manipulated to change the extent of its respective shank 514 within groove 508. As the extent of shank 514 within groove 508 is increased, tip 512 will push against bottom 408 of bottom panel adapter 400. Similarly, as the extent of shank 514 within groove 508 is decreased, tip 512 will retract away from bottom 408 and permit bottom 408 of bottom panel adapter 400 to settle into channel 504. Accordingly, each panel 200 is plumbed or adjusted in height by manipulating one or more jacking bolts 510 having tips 512 in contact or engaged with bottom 408 of bottom panel adapters 400.

Returning back to FIG. 4, bottom 408 in an embodiment of bottom panel adapter 400 is illustrated having channel 410 along bottom edge 412. Channel 410 is configured for engagement within groove 508 in channel 504 of bottom panel shelf 500. In some embodiments of bottom panel adapter 400, channel 410 includes opening 414 into groove 416 and channel wall or surface 418. In some embodiments, opening 414 is configured or sized for permitting at least a portion of the adjustment mechanism to extend into groove 416. As such, when channel 410 is positioned within groove 508 of channel 504, at least a portion of the adjustment mechanism will extend into or can be manipulated to extend into grove 416 such that at least a portion of the adjustment mechanism contacts at least a portion of wall 418 of channel 410. The extent of channel 410 (or bottom 408) within groove 508 of channel 504 is then adjustable by manipulating, for instance by pushing, the adjustment mechanism relative to, for instance against, wall 418 of channel 410. For instance, in a non-limiting exemplary embodiment, opening 414 is sized to permit passage of shank 514 of each jacking bolt 510 into groove 416. Accordingly, with channel 410 positioned within groove 508 of channel 504, shank 514 of each jacking bolt 510 extending through wall 518 will further extend into groove 416 and tip 512 of jacking bolt 510 will contact wall 418 of channel 410. The extent of channel 410 (or bottom 408) within groove 508 of channel 504 is then adjustable by manipulating jacking bolts 510 as described herein above. In alternate embodiments, channel 410 is a solid devoid of groove 416 such that at least a portion of the adjustment mechanism extends into opening 414. For instance, in a non-limiting exemplary embodiment having one or more jacking bolts 510, tip 512 and/or at least a portion of shank 514 of each jacking bolt 510 extends into opening 414. In another embodiment, channel 410 is a solid devoid of both opening 414 and groove 416 such that at least a portion of the adjustment mechanism contacts the surface or wall of channel 410 oppositely adjacent to or in contact with wall 518 of channel 504. In the non-limiting exemplary embodiment having one or more jacking bolts 510, tip 512 of each jacking bolt 510 contacts the surface or wall of channel 410 oppositely adjacent to or in contact with wall 518 of channel 504. In yet another embodiment, bottom panel adapter 400 does not include channel 410 along bottom edge 412. In such embodiments bottom edge 412 is placed within groove 508 of channel 504 such that at least a portion of the adjustment mechanism engages or contacts at least a portion of bottom edge 412, and the extent of bottom panel adapter 400 within channel 504 is adjusted by manipulating the adjustment mechanism. In the non-limiting exemplary embodiment having one or more jacking bolts 510, tip 512 of each jacking bolt 510 engages or contacts bottom edge 412, and the extent of bottom panel adapter 400 within channel 504 is adjusted by manipulating the one or more jacking bolts 510 as described herein above.

In an embodiment of bottom panel shelf 500, holes 516 through wall 518 of groove 508 are threaded to enable the engagement, retention and rotational manipulation of jacking bolts 510. In an alternate embodiment, such as that illustrated in FIG. 5, bottom panel shelf 500 includes channel 520 having groove 522 in opposed relation to groove 508 of channel 504 such that wall 518 is a common wall between grooves 508 and 522. In one such embodiment, groove 522, defined by opposing side walls 524 is configured for receiving and providing non-slip engagement for nut 526 around threaded shank 514 of jacking bolt 510. For this purpose, the width of groove 522, i.e., the distance between opposing side walls 524, is essentially equal to or slightly larger than a distance between opposing parallel edges of nut 526. Therefore, opposing side walls 524 will engage nut 526 in substantially the same manner as the jaws of a wrench and provide non-slip engagement of nut 526 for threading shank 514 of jacking bolt 510 therethrough. In one such embodiment, nut 526 threaded onto a leading end of shank 514 of jacking bolt 510 is received within groove 522 through either one of the two ends of channel 520 and positioned such that continued threading of jacking bolt 510 through nut 526 extends tip 512, and at least a portion of shank 514, through hole 516 in wall 518 and into groove 508 of channel 504. As described herein above, tip 512 of jacking bolt 510 will engage or contact bottom 408 of bottom panel adapter 400. Panel 200 is plumbed and/or adjusted in height by manipulating one or more jacking bolts 510 to adjust the extent of bottom panel adapter 400 within channel 504 of bottom panel shelf 500.

As illustrated in FIG. 5, bottom panel shelf 500 further includes protrusion 528 at a tip of wall 530 extending from back surface 532 of wall 502. As shown, protrusion 528 is essentially a shallow and narrow channel including groove 534 defined at least in part by at least a portion of wall 530 having lip 536 at the tip thereof and at least a portion of wall 538 extending from wall 530. As will be described herein below with reference to FIG. 6, protrusion 528 is configured for complementary engagement with a protrusion on a surface of sill girt 600. The affixation (or securement) of bottom panel shelf 500 to sill girt 600 is also described herein below.

Figure 6:
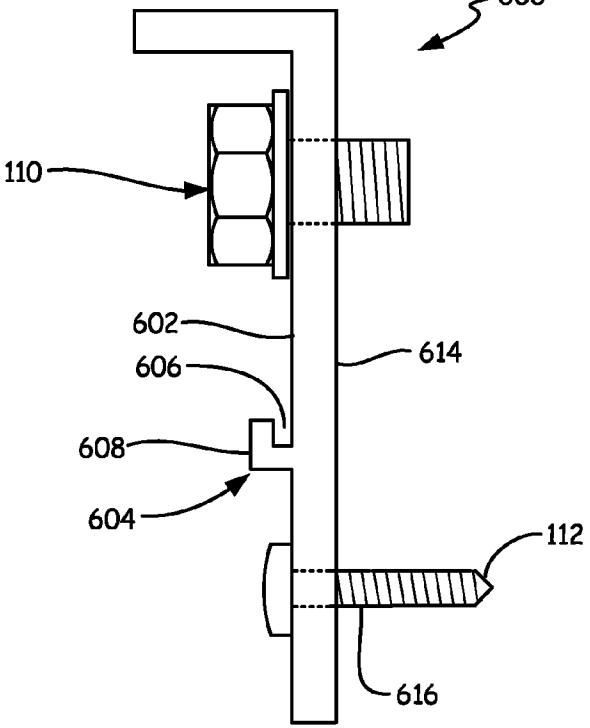
FIG. 6 is a side end view of an embodiment of a sill girt as viewed from either one of the two side edges.

FIG. 6 illustrates a non-limiting exemplary embodiment of sill girt 600. Protruding from front surface 602 of sill girt 600 is protrusion 604 configured for complementary engagement with protrusion 528 on back surface 530 of bottom panel shelf 500. As illustrated, protrusion 604 is essentially a shallow and narrow channel including groove 606 defined at least in part by lip 608 and at least a portion of opposing wall 602.

In some embodiments, protrusions 528 and 604 are configured for complementary engagement as follows. Protrusions 528 and 604 are configured as substantially shallow and narrow opposing channels. In certain embodiments, the depths of grooves 534 and 606 are substantially equal and the widths of grooves 534 and 606 are substantially equal and also substantially the same as the thicknesses of lips 608 and 536 respectively received therewithin. However, regardless of the described equalities of the depths, widths and thicknesses, groove 534 of protrusion 528 is configured for receiving, and retaining therewithin, lip 608 of protrusion 604, and groove 606 of protrusion 604 is configured for receiving, and retaining therewithin, lip 536 of protrusion 528. One non-limiting exemplary embodiment of such complementary configuration and engagement of protrusions 528 and 604 is illustrated in FIG. 1A at call-out 5-6.

Sill girt 600 further includes one or more holes 610 through which one or more fastening devices 110 secure sill girt 600 to exterior surface 106 of wall 104. In some embodiments and/or sections of wall 102, such as that illustrated in FIG. 1A, one or more shims 108 are used between back surface 614 of sill girt 600 and exterior surface 106 of wall 104.

Attention is now directed to both FIGS. 5 and 6. In FIG. 5, the embodiment of bottom panel shelf 500 is illustrated including one or more holes 540 extending through wall 538. In FIG. 6, the embodiment of sill girt 600 is illustrated including one or more holes 616 extending between front and back surfaces 604 and 614, respectively. Holes 540 and 616 are aligned with each other such that bottom panel shelf 500 and sill girt 600 are secured to each other with fastening device 112 extending through each hole 540 and 616. In some embodiments wherein holes 540 and 616 are configured for passage of at least a portion of fastening device 112, for example the shank of a bolt, shims 108 and/or exterior wall 104 receive an end of fastening device 112. In certain embodiments, both holes 540 and 616 are configured, for example threaded, for engaging and retaining at least a portion of fastening device 112 for securing bottom panel shelf 500 and sill girt 600 to each other. In alternate embodiments, holes 540 are configured for passage of fastening device 112 and holes 616 are configured, for example threaded, for engaging and retaining at least a portion of fastening device 112. All embodiments and alternatives thereof for securing bottom panel shelf 500 and sill girt 600 to each other are considered as being within the metes and bounds of the instant disclosure.

Figure 7:
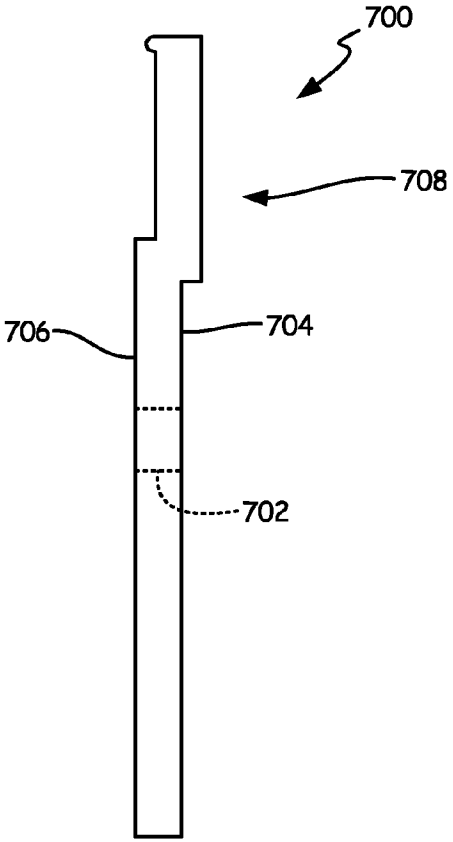
FIG. 7 is a side end view of an embodiment of a top panel adapter as viewed from either one of the two side edges.

FIG. 7 illustrates a side end view of a non-limiting exemplary embodiment of top panel adapter 700 as viewed from either one of its two side edges. Top panel adapter 700 includes two or more spaced apart holes 702 extending therethrough between front and back surfaces 704 and 706, respectively. Holes 702 are configured substantially the same as holes 402 in bottom panel adapter 400 as described herein above with reference to FIG. 4. At least one top panel adapter 700 is secured to each anchor plate 300 affixed proximate top edge 214 of panel 200 in substantially the same manner as described herein above for securing at least one bottom panel adapter 400 to each anchor plate 300 affixed proximate bottom edge 216 of panel 200. Alternate embodiments for securing top panel adapter 700 to anchor plate 300, as will become apparent to one skilled in the art, are considered as being within the intent, scope and spirit of the instant disclosure.

As illustrated in FIG. 7, top panel adapter 700 further includes engagement section 708 protruding from front surface 704. In some embodiments, and as described herein below with reference to FIG. 8, engagement section 708 is configured for engagement with one or more top panel shelves 800 for securing top edges 214 of panels 200 to exterior wall 104. As such, top panel adapter 700 and top panel shelf 800 are interfacing or interlocking components of an embodiment of a paneling system for attaching or securing panels 200 to exterior surface 106 of exterior wall 104.

Figure 8:
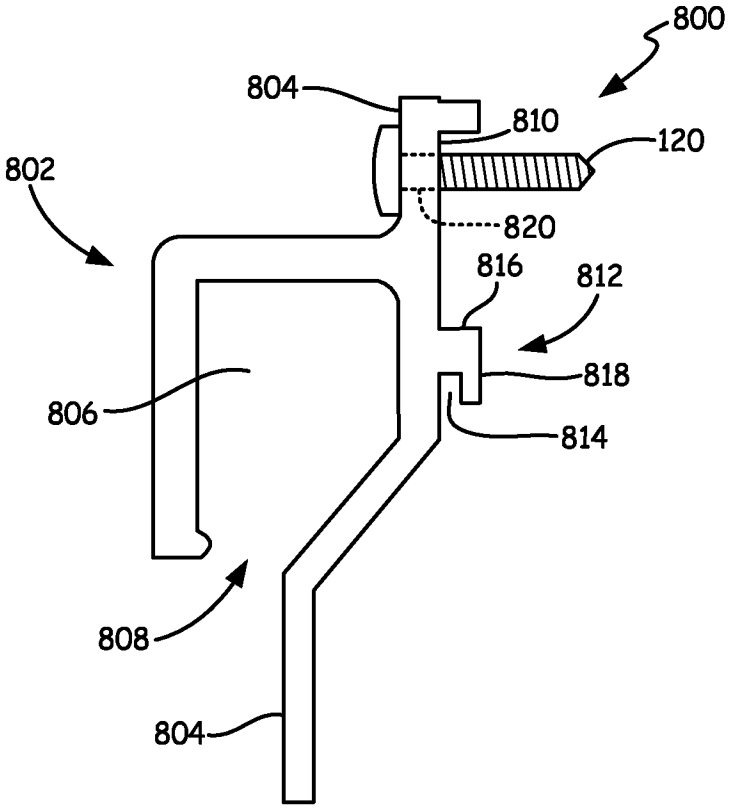
FIG. 8 is a side end view of an embodiment of a top panel shelf as viewed from either one of the two side edges.

FIG. 8 is a side end view of an embodiment of top panel shelf 800 as viewed from one of its two side edges. Each top panel shelf 800 includes channel 802 protruding from front surface 804 thereof. As illustrated, channel 802 includes groove 806 configured for receiving, through opening 808, at least a portion of engagement section 708 of top panel adapter 700. Protruding from back surface 810 of top panel shelf 800 is protrusion 812 configured for complementary engagement with head girt 900 as described herein below with reference to FIG. 9. As illustrated, protrusion 812 is essentially a shallow and narrow channel including groove 814 defined by wall 816 including lip 814 at a tip thereof and at least a portion of opposing back surface 810.

Figure 9:
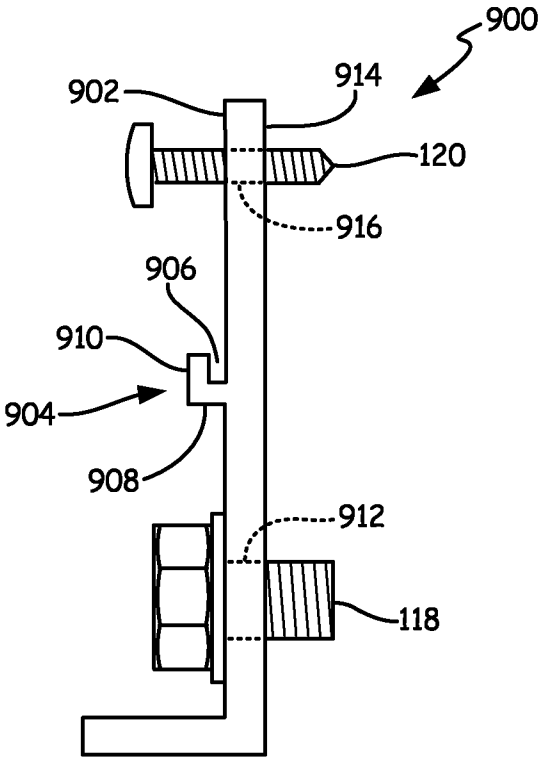
FIG. 9 is a side end view of an embodiment of a head girt as viewed from either one of the two side edges.

FIG. 9 is a non-limiting exemplary illustration of an embodiment of head girt 900. Protruding from front surface 902 of head girt 900 is protrusion 904 configured for complementary engagement with protrusion 812 on back surface 810 of top panel shelf 800. As illustrated, protrusion 904 is essentially a shallow and narrow channel including groove 906 defined by wall 908 including lip 910 at a tip thereof and at least a portion of front surface 902.

In some embodiments of a paneling system, protrusions 812 and 904 are configured for complementary engagement substantially similar to that of protrusions 528 and 604 as described herein above with reference to bottom panel adapter 500 and bottom panel shelf 600 illustrated in FIGS. 5 and 6. Accordingly, groove 814 is configured for receiving, and retaining therewithin, lip 910, and groove 906 is configured for receiving, and retaining therewithin, lip 818. One non-limiting exemplary embodiment of such complementary configuration and engagement of protrusions 812 and 904 is illustrated in FIG. 1B at call-out 8-9.

Head girt 900 further includes one or more holes 912 through which one or more fastening devices 118 secure head girt 900 to exterior surface 106 of exterior wall 104. In some embodiments and/or sections of wall 104, such as that illustrated in FIG. 1B, one or more shims 116 are used between back surface 914 of head girt 900 and exterior surface 106 of wall 104.

In some embodiments of a paneling system, top panel shelf 800 and head girt 900 are affixed to one another and/or to wall 104 with fastening device 120 extending through respective aligned holes 820 and 916. Embodiments for such affixation have been described herein above with reference to the affixation of bottom panel shelf 500 and sill girt 600 and therefore are not repeated here.

Figure 10A:
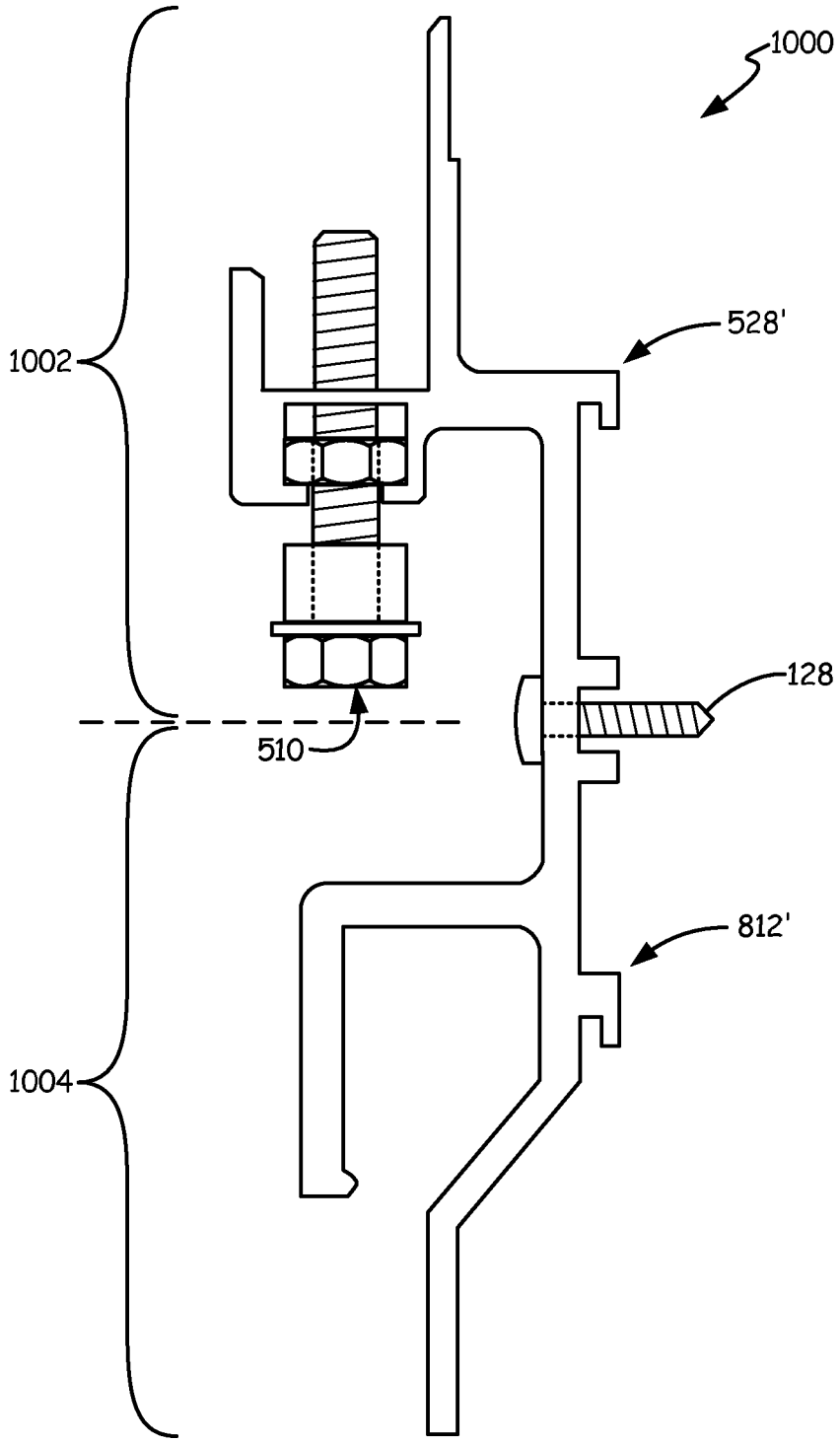
FIG. 10A is a side end view of an embodiment of a unitary panel shelf as viewed from either one of the two side edges.
Figure 10B:
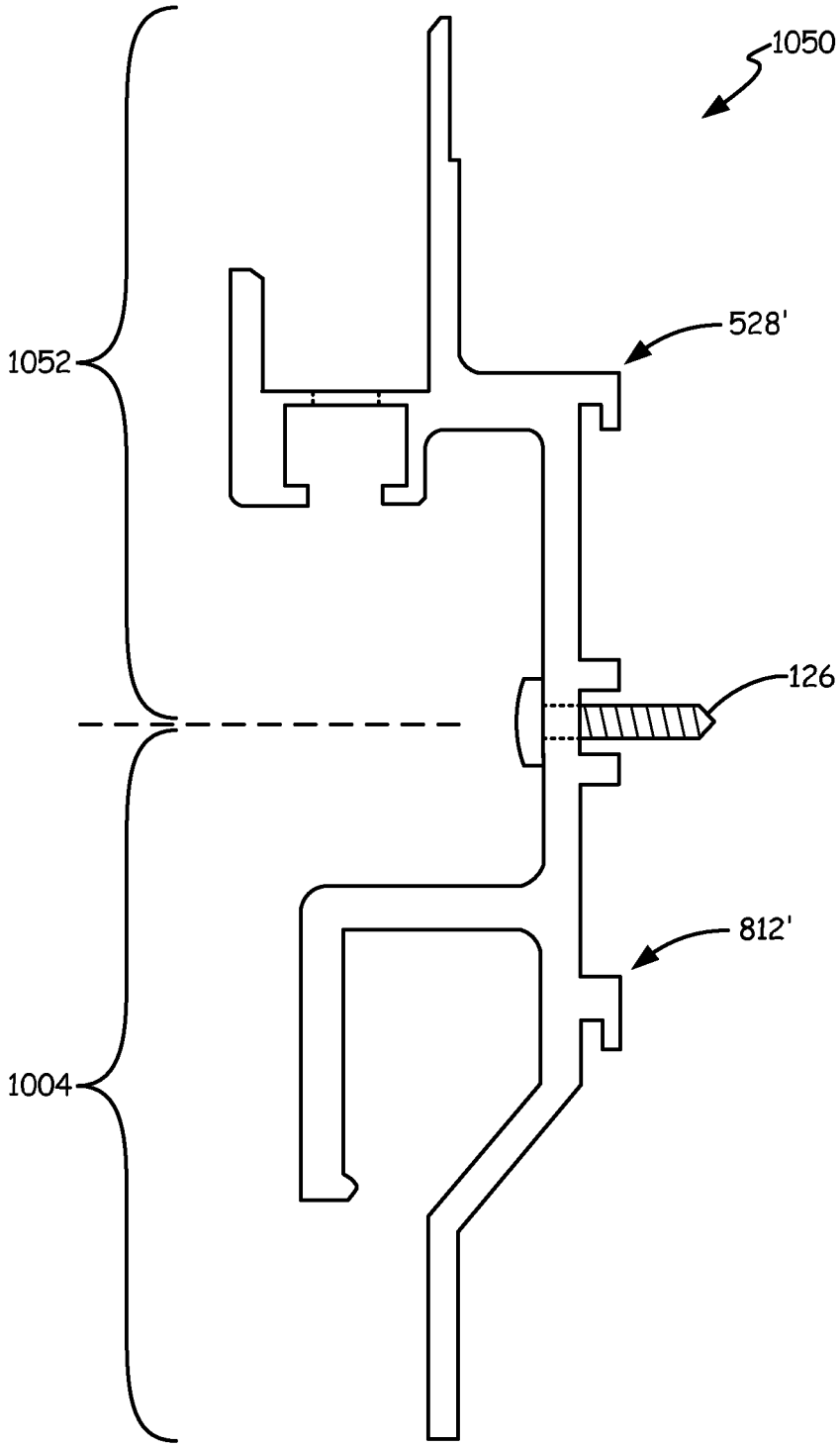
FIG. 10B is a side end view of an alternate embodiment of the unitary panel shelf of FIG. 10A.

FIGS. 10A and 10B are non-limiting exemplary illustrations of side end views of embodiments of substantially similar panel shelves 1000 and 1050 as viewed from one of their respective two side edges. As described herein above with reference to FIGS. 1C and 1D, panel shelf 1000 is used for securing vertically adjacent panels 200B and 200T along their respective top and bottom edges, and panel shelfs 1050 is used for attaching panels 200 to wall 104 at locations in addition to those along the top and bottom edges of panels 200. Accordingly, panel shelf 1000 includes one or more adjustment mechanisms for plumbing top panels 200T in substantially the same manner as that described herein above with reference to FIGS. 5 and 6. In a non-limiting exemplary embodiment, the adjustment mechanism is a jacking bolt 510. In contrast thereto, panel shelf 1050 does not include any adjustment mechanisms. As illustrated, with the exception of one or more adjustment mechanisms, first sections 1002 and 1052 of panel shelves 1000 and 1050, respectively, are substantially identical to bottom panel shelf 500 described herein above with reference to FIG. 5. Furthermore, second section 1004 of each panel shelf 1000 and 1050 is substantially identical to top panel shelf 800 described herein above with reference to FIG. 8. Therefore, each panel shelf 1000 is essentially a unitary single one-piece component incorporating, and therefore equivalent to, bottom panel shelf 500 and top panel shelf 800. In other words, panel shelf 1000 is a unitary single one-piece component defined at least in part by bottom panel shelf 500 and top panel shelf 800. Stated alternatively, panel shelf 1000 is a unitary single one-piece component having two sections of which one section is substantially similar to bottom panel shelf 500 and the other section is substantially similar to top panel shelf 800. Similarly, each panel shelf 1050 is essentially a unitary single one-piece component incorporating bottom panel shelf 500 without any adjustment mechanisms (for example, jacking bolts 510) and top panel shelf 800. Accordingly, first sections 1002 and 1052 are configured for receiving at least a portion of one or more bottom panel adapters 400 affixed to one or more top panels 200T, and second section 1004 is configured for receiving at least a portion of one or more top panel adapters 700 affixed to one or more bottom panels 200B. If both top and bottom panels 200T and 200B have been installed, then each adjustment mechanism (for example jacking bolt 510) is accessed with a manipulating device, for example a wrench or similar device, advanced through a gap between panels 200T and 200B.

Figure 11:
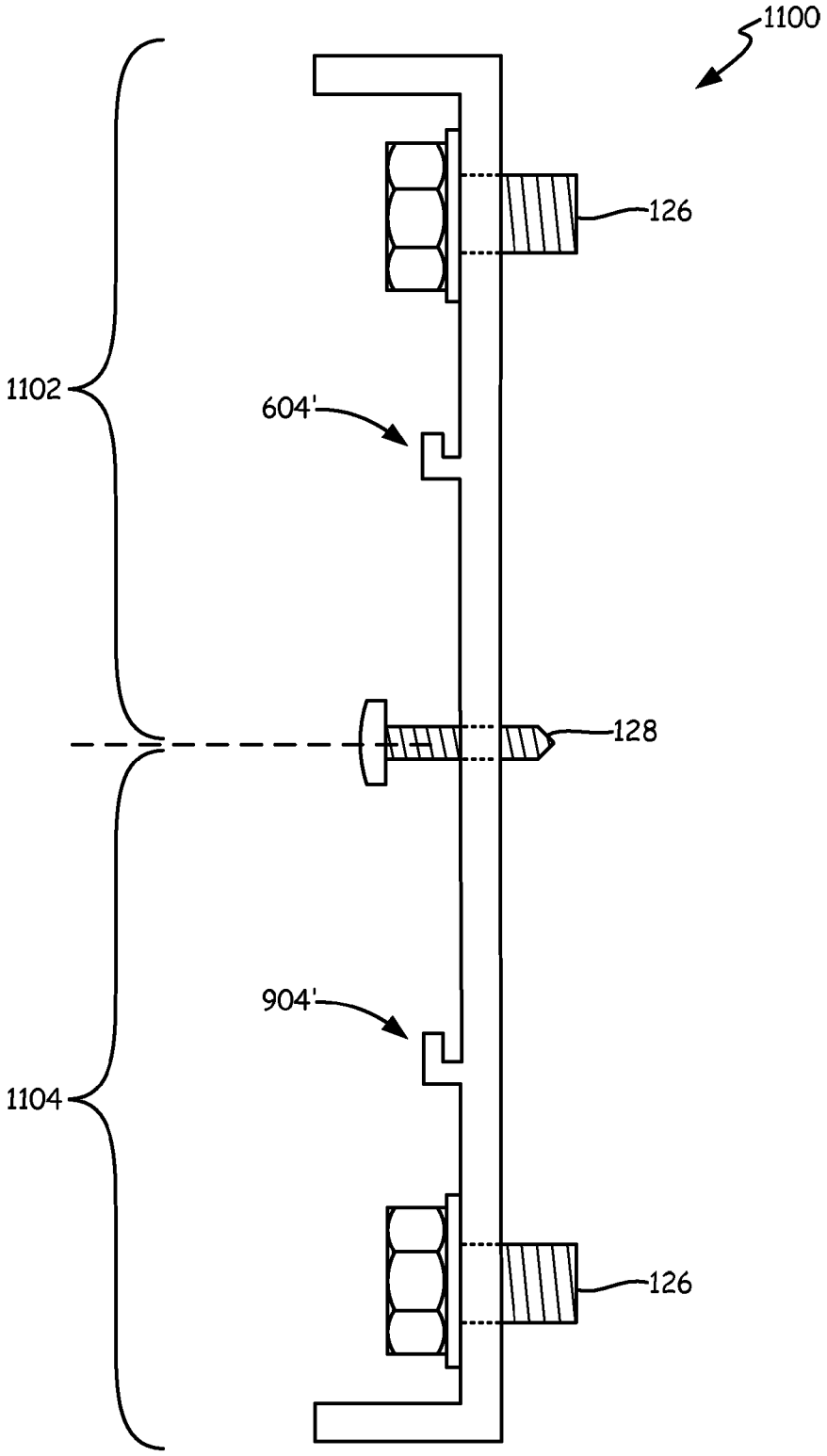
FIG. 11 is a side end view of an embodiment of a unitary wall girt as viewed from either one of the two side edges.

FIG. 11 is a non-limiting exemplary illustration of side end view of an embodiment of wall girt 1100 as viewed from one of its two side edges. As illustrated, first section 1102 of wall girt 1100 is substantially identical to sill girt 600 described herein above with reference to FIG. 6, and second section 1104 of wall girt 1100 is substantially identical to head girt 900 described herein above with reference to FIG. 9. Therefore, each wall girt 1100 is essentially a unitary single one-piece component incorporating, and therefore equivalent to, sill girt 600 and head girt 900. In other words, wall girt 1100 is a unitary single one-piece component defined at least in part by sill girt 600 and head girt 900. Stated alternatively, wall girt 1100 is a unitary single one-piece component having two sections of which one section is substantially similar to sill girt 600 and the other section is substantially similar to head girt 900.

As described herein above with reference to FIGS. 5 and 6, bottom panel shelf 500 and sill girt 600 respectively include protrusions 528 and 604 configured for complementary engagement. And, also as described herein above with reference to FIGS. 8 and 9, top panel shelf 800 and head girt 900 respectively include protrusions 812 and 904 configured for complementary engagement. Additionally, as described herein above with reference to FIGS. 10A, 10B and 11, each panel shelf 1000 and 1050 is substantially similar to bottom panel shelf 500 and top panel shelf 800, and each wall girt 1100 is substantially similar to sill girt 600 and head girt 900. Accordingly, wall girt 1100 and each panel shelf 1000 and 1050 include substantially similar pairs of protrusions configured for complementary engagement. As illustrated in FIGS. 10A, 10B and 11, one of the pairs configured for complementary engagement includes protrusions 528' and 604', and the other pair configured for complementary engagement includes protrusions 812' and 904'. Non-limiting exemplary embodiments of these complementary configurations and engagements are illustrated in FIGS. 1C and 1D at call-outs 5'-6' for the pair of protrusions 528' and 604' and at call-outs 8'-9' for the pair of protrusions 812' and 904'.

In view of the descriptions for the individual components presented herein above with reference to FIGS. 1A-11, alternate embodiments of one or more of the individual components will be apparent to one skilled in the art. For example, one skilled in the art might be motivated to combine one or more components into a unitary single one-piece component including all or some of the features of the individual components that are combined. Some non-limiting exemplary embodiments of such unitary components are described herein above as panel shelves 1000 and 1050 and as wall girt 1100 as illustrated in FIGS. 10A, 10B and 11, respectively. Further non-limiting exemplary embodiments of such additional unitary components are described herein below with reference to FIGS. 12-17.

Figure 12:
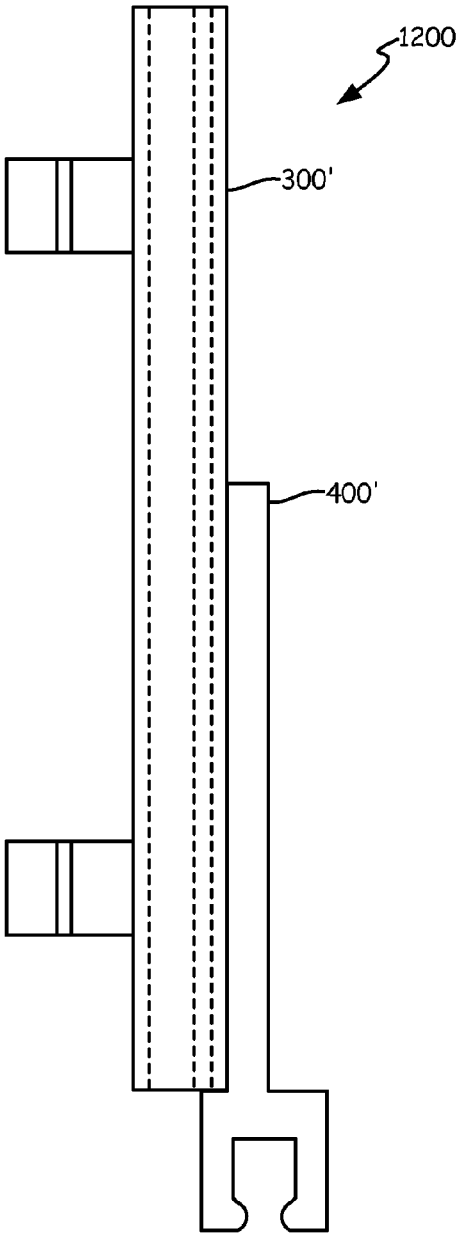
FIG. 12 is a side end view of an alternate embodiment of a bottom panel adapter.

FIG. 12 illustrates an alternate non-limiting exemplary embodiment of bottom panel adapter 1200. As shown, bottom panel adapter 1200 is a unitary single one-piece component including sections 300' and 400', wherein section 300' is substantially similar to anchor plate 300 and section 400' is substantially similar to bottom panel adapter 400. A back surface of bottom panel adapter 1200 is affixed to back surface 202 of panel 200 in substantially the same manner as back surface 304 of anchor plate 300.

Figure 13:
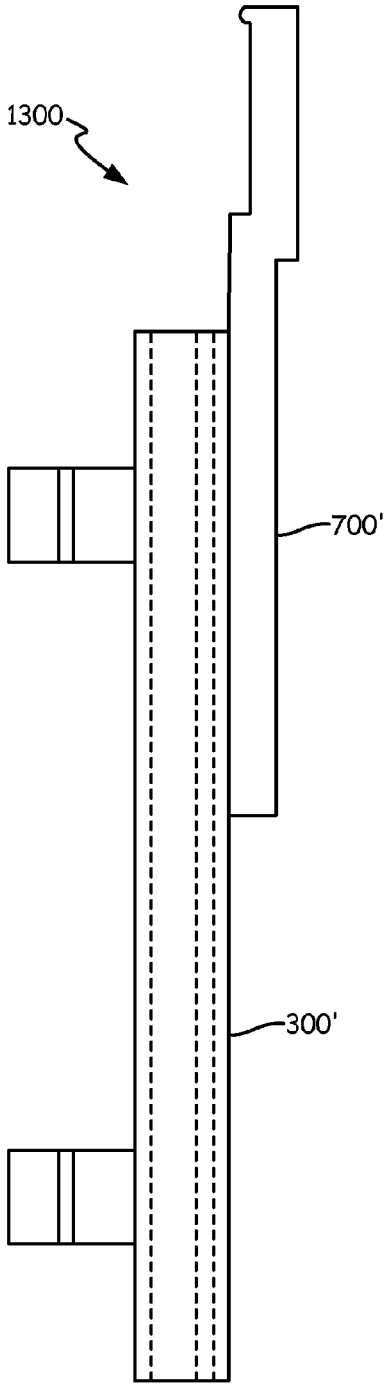
FIG. 13 is a side end view of an alternate embodiment of a top panel adapter.

FIG. 13 illustrates an alternate non-limiting exemplary embodiment of top panel adapter 1300. As shown, top panel adapter 1300 is a unitary single one-piece component including sections 300' and 700', wherein section 300' is substantially similar to anchor plate 300 and section 700' is substantially similar to top panel adapter 700. A back surface of top panel adapter 1300 is affixed to back surface 202 of panel 200 in substantially the same manner as back surface 304 of anchor plate 300.

Figure 14:
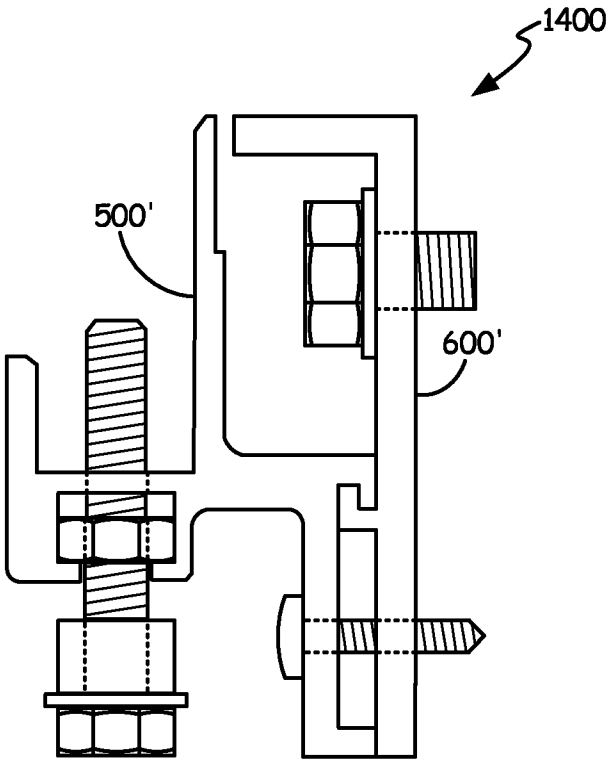
FIG. 14 is a side end view of an alternate embodiment of a sill girt.

FIG. 14 illustrates an alternate non-limiting exemplary embodiment of sill girt 1400. As shown, sill girt 1400 is a unitary single one-piece component including sections 500' and 600', wherein section 500' is substantially similar to bottom panel shelf 500 and section 600' is substantially similar to sill girt 600. A back surface of sill girt 1400 is affixed to external surface 106 of external building wall 104 in substantially the same manner as back surface 614 of sill girt 600.

Figure 15:
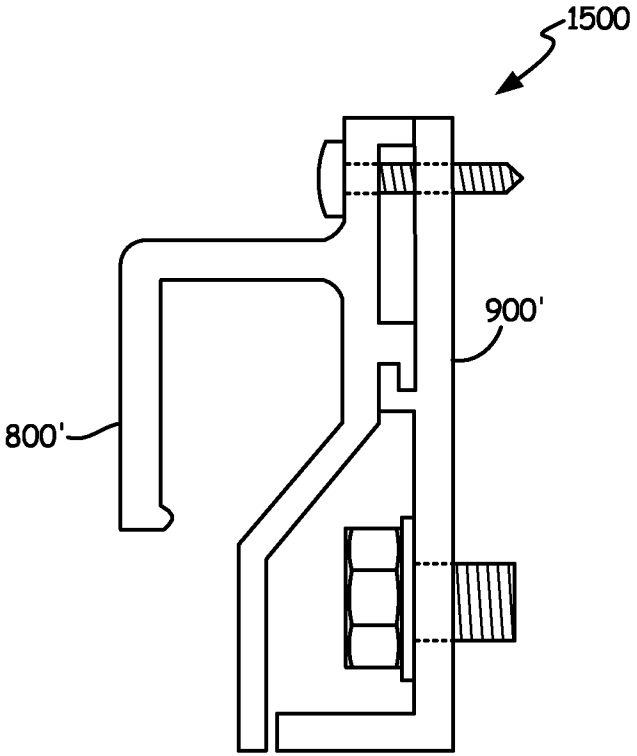
FIG. 15 is a side end view of an alternate embodiment of a head girt.

FIG. 15 illustrates an alternate non-limiting exemplary embodiment of head girt 1500. As shown, head girt 1500 is a unitary single one-piece component including sections 800' and 900', wherein section 800' is substantially similar to top panel shelf 800 and section 900' is substantially similar to head girt 900. A back surface of head girt 1500 is affixed to external surface 106 of external building wall 104 in substantially the same manner as back surface 914 of head girt 900.

Figure 16:
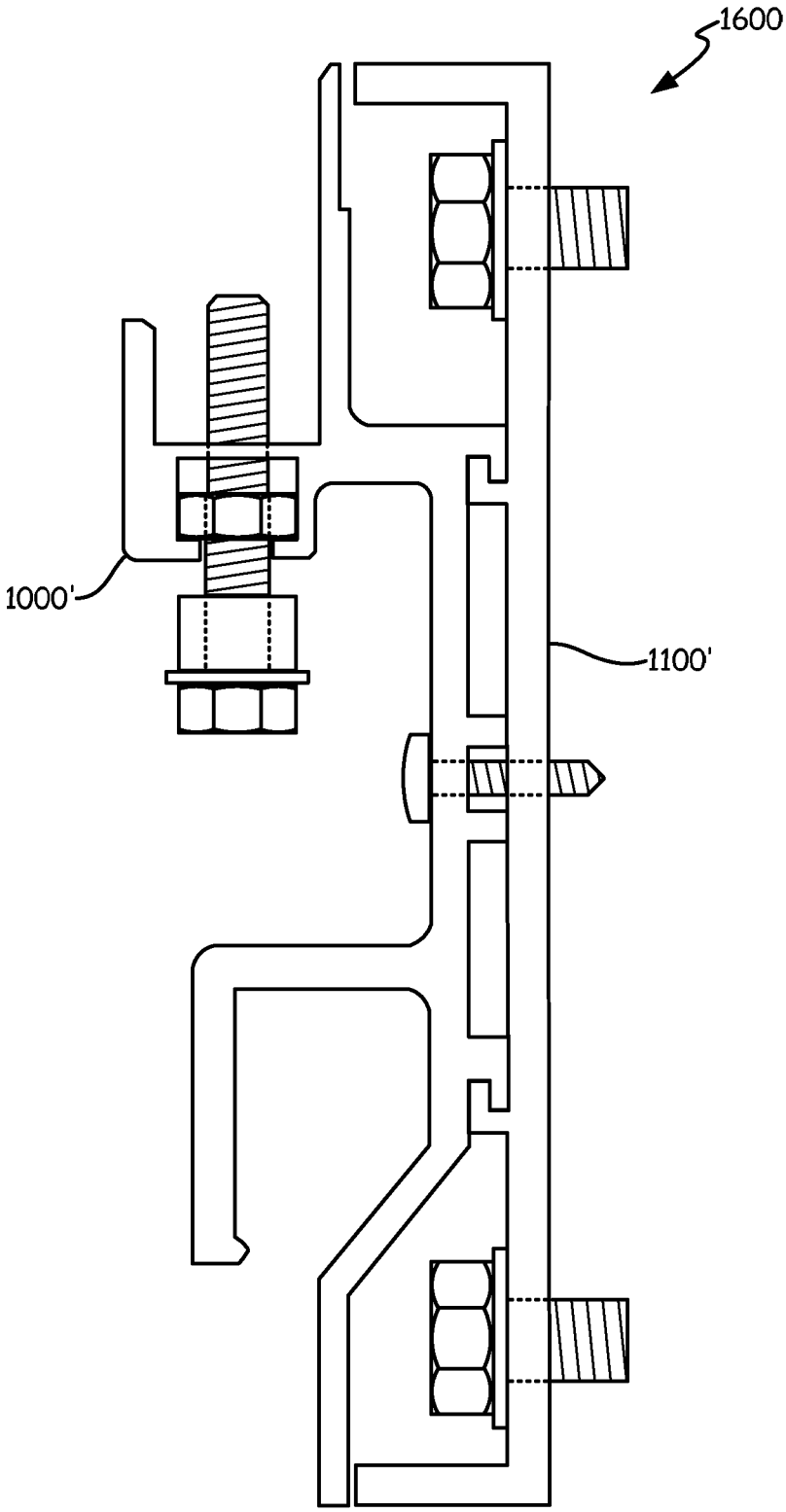
FIG. 16 is a side end view of an alternate embodiment of a wall girt.

FIG. 16 illustrates an alternate non-limiting exemplary embodiment of wall girt 1600. As shown, wall girt 1600 is a unitary single one-piece component including sections 1000' and 1100', wherein section 1000' is substantially similar to panel shelf 1000 and section 1100' is substantially similar to wall girt 1100. A back surface of wall girt 1600 is affixed to external surface 106 of external building wall 104 in substantially the same manner as a back surface of wall girt 1100.

Figure 17:
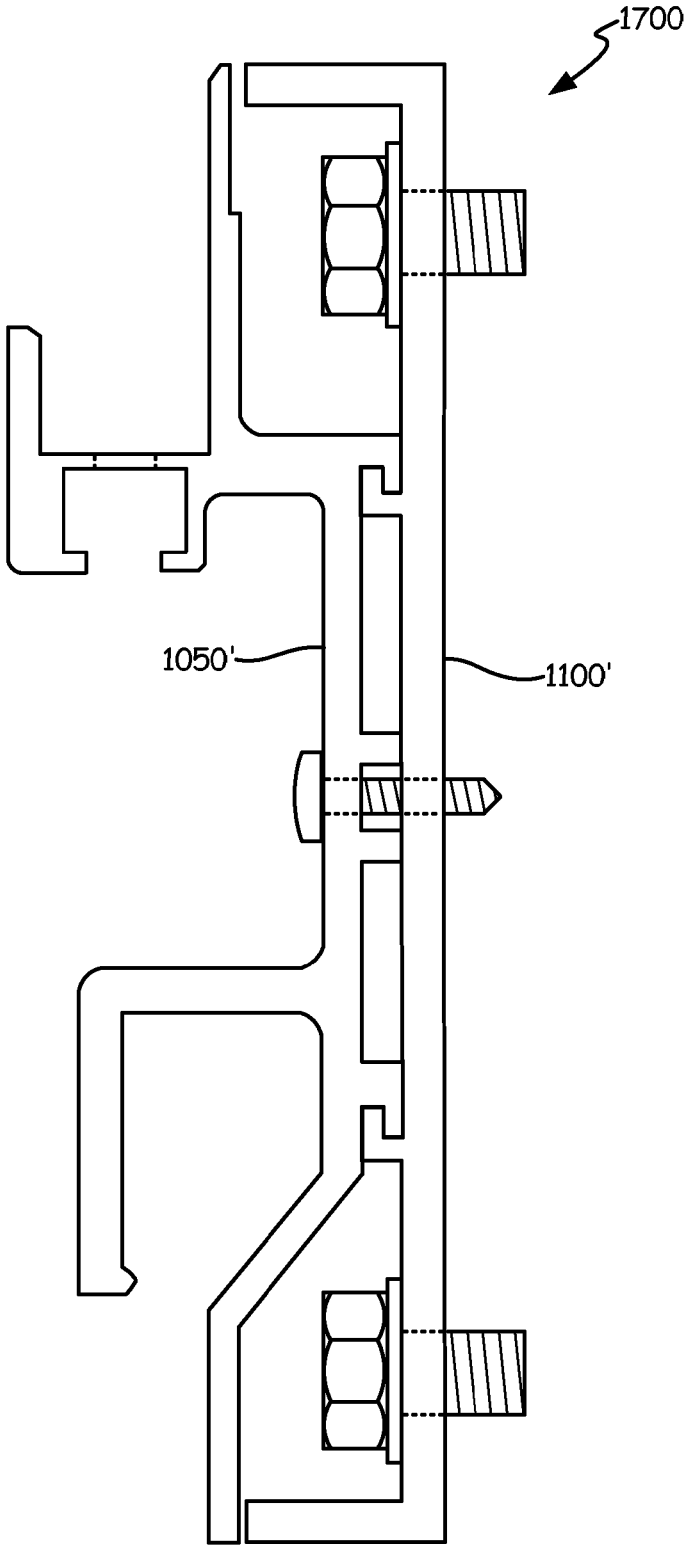
FIG. 17 is a side end view of another embodiment of a wall girt.

FIG. 17 illustrates another non-limiting exemplary embodiment of wall girt 1700. As shown, wall girt 1700 is a unitary single one-piece component including sections 1050' and 1100', wherein section 1050' is substantially similar to panel shelf 1050 and section 1100' is substantially similar to wall girt 1100. A back surface of wall girt 1700 is affixed to external surface 106 of external building wall 104 in substantially the same manner as a back surface of wall girt 1100.

Additional and/or alternate embodiments of any of one or more individual and/or unitary single one-piece components as will be apparent to one skilled in the art are considered as being within the metes and bounds of the instant disclosure. For instance, in a non-limiting exemplary embodiment, a unitary single one-piece component includes a panel and one or more anchor plates. In another non-limiting exemplary embodiments, a unitary single one-piece component includes an anchor plate and a bottom panel adapter. In yet another non-limiting exemplary embodiments, a unitary single one-piece component includes an anchor plate and a top panel adapter. In certain non-limiting exemplary embodiments, a unitary single one-piece component includes a panel, an anchor plate and either a bottom panel adapter or a top panel adapter or both a bottom and a top panel adapter. As can be seen, a unitary single one-piece component can include one or more different components and/or at least a portion of or the entirety of one or more components.

A non-limiting exemplary method for installing one or more panels 200 in a paneling system such as 102, 114, 122 and 130 includes affixing (or securing or attaching) two or more anchor plates 300 on back surface 202 of each of the one or more panels 200. At least one anchor plate 300 is secured (or affixed or attached) along top edge 214 of each panel 200 and at least one anchor plate 300 is attached (or secured or affixed) along bottom edge 216 of each panel 200. For anchor plates 300 including one or more standoffs 322 extending from back surface 304 thereof, one or more holes 212 are provided on back surface 202. In some embodiments, one or more holes 212 extend into at least a portion of core 204 of each panel 200. The positional relationships between one or more holes 212 corresponds to the positional relationships between standoffs 322. One or more securement compositions such as an adhesive, caulk, epoxy, building construction glue, etc., are placed within each hole 212 and at least one barb 322 is submerged into the composition. In some embodiments, the composition is applied to one or both back surfaces 202 and 304 before placing them in contact. In alternate embodiments wherein anchor plates 300 do not include one or more standoffs 322, holes 212 are not required. Therefore, the composition is applied to one or both back surfaces 202 and 304 before placing them in contact. The composition is permitted to cure thereby affixing (or securing or attaching) anchor plate 300 to panel 200.

Front surface 302 of each anchor plate 300 includes at least one pair of substantially parallel channels 306 configured for non-slip engagement of a head of one more fastening devices therewithin with a shank of each fastening device extending away from front surface 302 of anchor plate 300. One or more bottom panel adapters 400, having one or more holes 402 is affixed (or secured) to anchor plates 300 with the shank of the at least one of the fastening devices engaged in anchor plate 300 extending through at least one hole 402. At least one bottom panel adapter 400 is affixed to at least one anchor plate 300 along bottom edge 216 of each panel 200. Similarly, one or more top panel adapters 700, having one or more holes 702 is affixed (or secured) to anchor plates 300 with the shank of the at least one of the fastening devices engaged in anchor plate 300 extending through at least one hole 702. At least one top panel adapter 700 is affixed to at least one anchor plate 300 along top edge 214 of each panel 200. In embodiments wherein additional support is necessitated between top and bottom edges 214 and 216 of one or more panels 200, one or more bottom panel adapters 400 or one or more top panel adapters 700 are affixed to additional one of more anchor plates 300 at appropriate locations on back surface 202 of each such panel 200.

Sill girts 600 are affixed to wall 104 along a bottom edge thereof with one or more fastening devices 110. In some embodiments, one or more shims 108 are necessitated between back surface 614 of sill girt 600 and external surface 106 of wall 104 to adjust for abnormalities of and/or on exterior surface 106. One or more bottom panel shelves 500, each including back surface 530 configured for engagement with front surface 602 of sill girt 600, are affixed with one or more fastening devices 112 to shims 108 and/or to wall 104.

Head girts 900 are affixed to wall 104 along a top edge thereof with one or more fastening devices 118. In some embodiments, one or more shims 116 are necessitated between back surface 914 of head girt 900 and external surface 106 of wall 104 to adjust for abnormalities of and/or on exterior surface 106. One or more top panel shelves 800, each including back surface 810 configured for engagement with front surface 902 of head girt 900, are affixed with one or more fastening devices 120 to shims 116 and/or to wall 104.

Wall girts 1100 are affixed to wall 104 at predetermined locations between sill and head girts 600 and 900 with one or more fastening devices 126. In some embodiments, one or more shims 124 are necessitated between a back surface of wall girt 1100 and external surface 106 of wall 104 to adjust for abnormalities of and/or on exterior surface 106. One or more panel shelves 1000 and/or 1050, each including a back surface configured for engagement with a front surface of wall girt 1100, are affixed with one or more fastening devices 128 to shims 124 and/or to wall 104.

In accordance with a method for installing paneling systems 102, 114, 122 and 130, the one or more panels 200 are installed as follows.

For bottom-most panels 200, i.e., panels 200 installed along the bottom edge of wall 104, at least one combination of one or more bottom panel shelf 500 and sill girt 600 is affixed to wall 104 along the bottom edge thereof. Additionally, at least one combination of one or more panel shelf 1000 and wall girt 1100 is affixed to wall 104 above the combination affixed along the bottom edge of wall 104. Next, at least a portion of each top panel adapter 700 affixed to each panel 200 is received and engaged in that section of panel shelf 1000 that most closely resembles top panel shelf 800. (In accordance with the descriptions herein above, at least a portion of each top panel adapter 700 affixed to each panel 200 is received in groove 806 through opening 808 of channel 802 and engaged therewithin.) Then, at least a portion of each bottom panel adapter 400 affixed to each panel 200 is received and engaged in groove 508 of channel 504 on bottom panel shelf 500. Panel 200 is then plumbed and/or adjusted in height by manipulating one or more adjustment mechanisms (for example jacking screws 510).

For top-most panels 200, i.e., panels 200 installed along the top edge of wall 104, at least one combination of one or more top panel shelf 800 and head girt 900 is affixed to wall 104 along the top edge thereof. Additionally, at least one combination of one or more panel shelf 1000 and wall girt 1100 is affixed to wall 104 below the combination affixed along the top edge of wall 104. Next, at least a portion of each top panel adapter 700 affixed to each panel 200 is received in groove 806 through opening 808 of channel 802 and engaged therewithin. Then, at least a portion of each bottom panel adapter 400 affixed to each panel 200 is received and engaged in that section of panel shelf 1000 which most closely resembles bottom panel shelf 500. (In accordance with the descriptions herein above, at least a portion of each bottom panel adapter 400 affixed to each panel 200 is received and engaged in groove 508 of channel 504 on bottom panel shelf 500.) Panel 200 is then plumbed and/or adjusted in height by manipulating one or more adjustment mechanisms (for example jacking screws 510).

For intermediate individual panels 200 between bottom-most and top-most panels 200, including vertically adjacent panels 200T and 200B, a first and a second vertically adjacent combination, each including one or more panel shelf 1000 and wall girt 1100, are located or affixed to wall 104. For the purpose of this non-limiting example, the first combination is located vertically above the second combination. At least a portion of each top panel adapter 700 affixed to each panel 200 is received and engaged in that section of the first combination which most closely resembles top panel shelf 800. (In accordance with the descriptions herein above, at least a portion of each top panel adapter 700 affixed to each panel 200 is received in groove 806 through opening 808 of channel 802 and engaged therewithin.) Then, at least a portion of each bottom panel adapter 400 affixed to each panel 200 is received and engaged in that section of the second combination which most closely resembles bottom panel shelf 500. (In accordance with the descriptions herein above, at least a portion of each bottom panel adapter 400 affixed to each panel 200 is received and engaged in groove 508 of channel 504 on bottom panel shelf 500.) Panels 200 are then plumbed and/or adjusted for height by manipulating one or more adjustment mechanisms (for example jacking screws 510).

Panels 200 including additional bottom panel adapters 400 between their respective top and bottom edges are installed or secured as follows. First, each top panel adapter 700 is engaged in that section which most closely resembles top panel shelf 800 in a first appropriate combination including either top panel shelf 800 and head girt 900 or panel shelf 1000 and wall girt 1100. Next, all bottom panel adapters 400, i.e., those along bottom edges 216 of panels 200 and those at locations between top and bottom edges 214 and 216 of panels 200, are installed (or engaged) concurrently. All bottom panel adapters 400 along bottom edges 216 of panels 200 are received and engaged in that section which most closely resembles bottom panel shelf 500 in a second appropriate combination including either bottom panel shelf 500 and sill girt 600 or panel shelf 1000 and wall girt 1100. And, all bottom panel adapters 400 at locations between top and bottom edges 214 and 216 of panels 200 are received and engaged in that section which most closely resembles bottom panel shelf 500 in a third combination including panel shelf 1050 and wall girt 1100 affixed to wall 104 between the first and second appropriate combinations. Panels 200 are plumbed and/or adjusted for height by manipulating one or more adjustment mechanisms (for example jacking screws 510).

In alternate embodiments, top panel adapters 700 are used instead of bottom panel adapters between top and bottom edges 214 and 216 of panel 200. Accordingly, all top panel adapters 700 at locations between top and bottom edges 214 and 216 of panels 200 are received and engaged in that section which most closely resembles top panel shelf 800 in a third combination including panel shelf 1050 and wall girt 1100 affixed to wall 104 between the first and second appropriate combinations. Panels 200 are plumbed and/or adjusted for height by manipulating one or more adjustment mechanisms (for example jacking screws 510).

Various modifications and additions may be made to the non-limiting exemplary embodiments described hereinabove without departing from the scope, intent and spirit of the instant disclosure. For example, while the disclosed embodiments refer to particular features, the metes and bounds of the instant disclosure is considered to also include embodiments having various alternatives and/or combinations of features different from and/or in addition to those described hereinabove. Accordingly, all alternatives, modifications, and/or variations are considered as being within the metes and bounds of the instant disclosure.

We claim:

1. A paneling system comprising one or more panels;

two or more anchor plates, each anchor plate having a front surface configured for engaging one or more fastening devices; and a back surface configured for affixation to a back surface of one of said panels;

one or more bottom panel adapters, each bottom panel adapter configured for affixation to one of said anchor plates;

one or more top panel adapters, each top panel adapter configured for affixation to one of said anchor plates;

one or more bottom panel shelves, each bottom panel shelf having a first channel protruding from a front surface of said bottom panel shelf, said first channel configured for retaining an edge of said one or more bottom panel adapters;

one or more adjustment mechanisms configured for manipulating an orientation of said one or more panels;

one or more top panel shelves, each top panel shelf having a second channel protruding from a front surface of said top panel shelf, said second channel configured for retaining an edge of said one or more top panel adapters;

a sill girt configured for affixation to a wall, said sill girt having a front surface configured for engagement with a back surface of said one or more bottom panel shelves; and a head girt configured for affixation to said wall, said head girt having a front surface configured for engagement with a back surface of said one or more top panel shelves.

2. The paneling system of claim 1 having one or more panel shelves, each panel shelf comprising a first section substantially similar to one of said bottom panel shelves; and a second section substantially similar to one of said top panel shelves;

wherein, a groove in said first channel is in opposed relation to a groove in said second channel;

a wall girt configured for affixation to said wall, said wall girt comprising a first section substantially similar to said sill girt; and a second section substantially similar to said head girt;

wherein, a front surface of said wall girt is configured for engagement with a back surface of said panel shelf.

3. The paneling system of claim 1, wherein each panel includes one or more holes, each hole extending through said back surface of said panel and into at least a portion of a core of said panel; and each anchor plate comprises one or more standoffs, each standoff protruding from said back surface of said anchor plate and configured for securement within one of said holes in said panel; and at least one pair of substantially parallel channels on at least a portion of said front surface of said anchor plate, wherein each channel is configured for non-slip engagement of a head of at least one fastening device having a shank thereof extending away from said front surface of said anchor plate.

4. The paneling system of claim 3, wherein each of said one or more standoffs include one or more barbs.

5. The paneling system of claim 1, wherein each bottom panel adapter comprises one or more holes extending through front and back surfaces of said bottom panel adapter, each hole configured for engaging one of said fastening devices for affixing one bottom panel adapter to one of said anchor plates, wherein at least one bottom panel adapter is affixed to at least one anchor plate proximate a bottom edge of each panel; and each top panel adapter comprises one or more holes extending through front and back surfaces of said top panel adapter, each hole configured for engaging one of said fastening devices for affixing one top panel adapter to one of said anchor plates, wherein at least one bottom panel adapter is affixed to at least one anchor plate proximate a top edge of each panel.

6. The paneling system of claim 1, wherein each of said one or more adjustment mechanisms is a jacking bolt;

a tip of at least one of said jacking bolts is in contact with at least a portion of said edge of said bottom panel adapter; and an extent of said bottom panel adapter within said first channel is adjustable by manipulating one or more of said jacking bolts.

7. The paneling system of claim 6, comprising a third channel along said edge of said bottom panel adapter, said third channel configured for passage of a shank of said jacking bolts.

8. The paneling system of claim 6, wherein said bottom panel shelf comprises a common wall between a fourth channel having a groove in opposed relation to a groove of said first channel, said common wall having one or more holes, each hole configured for passage of at least said tip of said jacking bolt, said fourth channel configured for non-slip engagement of a nut disposed on a shank of said jacking bolt extending through said common wall.

9. The paneling system of claim 6, wherein each of said jacking bolt is rotatably engaged in one of one or more threaded holes in a wall of said first channel.

10. The paneling system of claim 1, wherein each of said back surface of said bottom panel shelf and said front surface of said sill girt comprises one of a first pair of protrusions configured for complementary engagement; and each of said back surface of said top panel shelf and said front surface of said head girt comprises one of a second pair of protrusions configured for complementary engagement.

11. The paneling system of claim 10, wherein said first pair of protrusions comprises a first pair of complementary grooves in opposed relation such that a wall of each groove is retained in a groove of an opposing groove; and said second pair of protrusions comprises a second pair of complementary grooves in opposed relation such that a wall of each groove is retained in a groove of an opposing groove.

12. A paneling system comprising one or more panels;

one or more bottom panel adapters, each bottom panel adapter configured for affixation to a back of said panels, wherein at least one of said bottom panel adapters is proximate a bottom edge of each panel;

one or more top panel adapters, each top panel adapter configured for affixation to said back of said panels, wherein at least one of said top panel adapters is proximate a top edge of each panel;

a sill girt configured for affixation to a wall, said sill girt having a first channel protruding from a front surface thereof, said first channel configured for retaining an edge of said one or more bottom panel adapters;

one or more adjustment mechanisms configured for manipulating an orientation of said one or more panels; and a head girt configured for affixation to said wall, said head girt having a second channel protruding from a front surface thereof, said second channel configured for retaining an edge of said one or more top panel adapters.

13. The paneling system of claim 12, having a wall girt configured for affixation to a wall, said wall girt comprising a third channel protruding from a front surface of said wall girt, wherein said third channel is substantially similar to said first channel; and a fourth channel protruding from said front surface of said wall girt, wherein said fourth channel is substantially similar to said second channel;

wherein a groove of said third channel is in opposed relation to a groove of said fourth channel.

14. The paneling system of claim 12, wherein each panel includes one or more holes, each hole extending through said back surface of said panel and into at least a portion of a core of said panel;

one or more standoffs protrude from a back surface of each of said bottom panel adapters, each standoff configured for securement within one of said holes in said panel; and one or more standoffs protrude from a back surface of each of said top panel adapters, each standoff configured for securement within one of said holes in said panel.

15. The paneling system of claim 12, wherein each of said one or more adjustment mechanisms is a jacking bolt;

a tip of at least one of said jacking bolts is in contact with at least a portion of said edge of each bottom panel adapter; and an extent of each bottom panel adapter retained within said first channel is adjustable by manipulating one or more of said jacking bolts.

16. A method for installing one or more panels, comprising affixing a back surface of two or more anchor plates to a back surface of each panel;

affixing one or more bottom panel adapters to a front surface of one of said anchor plates, wherein at least one bottom panel adapter is affixed to at least one anchor plate affixed proximate a bottom edge of each panel;

affixing one or more top panel adapters to a front surface of one of said anchor plates, wherein at least one top panel adapter is affixed to at least one anchor plate affixed proximate a top edge of each panel;

affixing a sill girt proximate a bottom of a wall;

affixing one or more bottom panel shelves to said sill girt, wherein a back surface of each bottom panel shelf is configured for engagement with a front surface of said sill girt; and a first channel protrudes from a front surface of each bottom panel shelf;

affixing a head girt proximate a top edge of said wall; and affixing one or more top panel shelves to said head girt, wherein a back surface of each top panel shelf is configured for engagement with a front surface of said head girt; and a second channel protrudes from a front surface of each top panel shelf.

17. The method of claim 16, further comprising engaging an edge of one of said top panel adapters affixed proximate said top edge of each panel into said second channel;

engaging an edge of one of said bottom panel adapters affixed proximate said bottom edge of each panel into said first channel; and plumbing each panel by manipulating one or more adjustment mechanisms associated with said first channel.

18. The method of claim 16, comprising affixing a first wall girt on said wall between said sill girt and said head girt; and affixing one or more first panel shelves to said first wall girt, each first panel shelf having a third channel protruding from a front surface thereof, wherein said third channel is substantially similar to said first channel;

a fourth channel protruding from said front surface thereof, wherein said fourth channel is substantially similar to said second channel and wherein said fourth channel is in opposed relation to said third channel; and a back surface configured for engagement with a front surface of said first wall girt.

19. The method of claim 18, further comprising engaging an edge of one of said top panel adapters affixed proximate a top edge of a first panel into said second channel;

engaging an edge of one of said bottom panel adapters affixed proximate a bottom edge of said first panel into said third channel;

plumbing said first panel by manipulating one or more adjustment mechanisms associated with said third channel;

engaging an edge of one of said top panel adapters affixed proximate a top edge of a second panel into said fourth channel;

engaging an edge of one of said bottom panel adapters affixed proximate a bottom edge of said second panel into said first channel; and plumbing said second panel by manipulating one or more adjustment mechanisms associated with said first channel.

20. The method of claim 18, further comprising engaging an edge of one of said top panel adapters affixed proximate a top edge of a panel into said second channel;

concurrently engaging an edge of one of said bottom panel adapters affixed proximate a bottom edge of said panel into said first channel; and an edge of one of said bottom panel adapters affixed to said panel between said top and bottom edges of said panel into said third channel; and plumbing said panel by manipulating one or more adjustment mechanisms associated with said first channel.

21. The method of claim 18, further comprising affixing a second wall girt on said wall between said first wall girt and said sill girt, wherein said second wall girt is substantially similar to said first wall girt; and affixing a second panel shelf to said second wall girt, wherein said second panel shelf is substantially similar to said first panel shelf, said second panel shelf comprising a fifth channel protruding from a front surface of said second panel shelf, wherein said fifth channel is substantially similar to said third channel;

a sixth channel protruding from said front surface of said second panel shelf, wherein said sixth channel is substantially similar to said fourth channel and wherein said sixth channel is in opposed relation to said fifth channel; and a back surface configured for engagement with a front surface of said second wall girt.

22. The method of claim 21, further comprising engaging an edge of one of said top panel adapters affixed proximate a top edge of a first panel into said second channel;

engaging an edge of one of said bottom panel adapters affixed proximate a bottom edge of said first panel into said third channel;

plumbing said first panel by manipulating one or more adjustment mechanisms associated with said third channel;

engaging an edge of one of said top panel adapters affixed proximate a top edge of a second panel into said sixth channel;

engaging an edge of one of said bottom panel adapters affixed proximate a bottom edge of said second panel into said first channel;

plumbing said second panel by manipulating one or more adjustment mechanisms associated with said first channel;

engaging an edge of one of said top panel adapters affixed proximate a top edge of a third panel into said fourth channel;

engaging an edge of one of said bottom panel adapters affixed proximate a bottom edge of said third panel into said fifth channel;

plumbing said third panel by manipulating one or more adjustment mechanisms associated with said fifth channel.

23. The method of claim 21, further comprising engaging an edge of one of said top panel adapters affixed proximate a top edge of a first panel into said second channel;

engaging an edge of one of said bottom panel adapters affixed proximate a bottom edge of said first panel into said third channel;

plumbing said first panel by manipulating one or more adjustment mechanisms associated with said third channel;

engaging an edge of one of said top panel adapters affixed proximate a top edge of a second panel into said fourth channel;

concurrently engaging an edge of one of said bottom panel adapters affixed proximate a bottom edge of said second panel into said first channel; and an edge of one of said bottom panel adapters affixed to said second panel between said top and bottom edges of said second panel into said fifth channel; and plumbing said second panel by manipulating one or more adjustment mechanisms associated with said first channel.

24. The method of claim 16, wherein affixing each of said anchor plates to said panel comprises providing one or more holes at predefined locations through said back surface of said panel, said one or more holes extending at least partially into a core of said panel;

positioning each of one or more standoffs extending from said back surface of each of said anchor plates into each corresponding one of said one or more holes; and securing each of said anchor plates to said panel, said step of securing selected from the group consisting of providing an adhesive in said one or more holes before positioning said one or more standoffs in said one or more holes;

providing said adhesive to said back surface of one or more of said anchor plates;

providing said adhesive to said back surface of said panel whereat one of said anchor plates is affixed;

providing a fastening device; and any combination thereof.

* * * * *